US011626652B2

(12) United States Patent
Vilenskiy et al.

(10) Patent No.: US 11,626,652 B2
(45) Date of Patent: Apr. 11, 2023

(54) RIDGE GAP WAVEGUIDE AND MULTILAYER ANTENNA ARRAY INCLUDING THE SAME

(71) Applicant: Samsung Electronics Co., Ltd., Gyeonggi-do (KR)

(72) Inventors: Artem Rudolfovitch Vilenskiy, Moscow (RU); Mikhail Nikolaevich Makurin, Moscow region (RU); Chongmin Lee, Gyeonggi-do (KR)

(73) Assignee: Samsung Electronics Co., Ltd

( * ) Notice: Subject to any disclaimer, the term of this patent is extended or adjusted under 35 U.S.C. 154(b) by 436 days.

(21) Appl. No.: 16/706,251

(22) Filed: Dec. 6, 2019

(65) Prior Publication Data

US 2020/0185802 A1 Jun. 11, 2020

(30) Foreign Application Priority Data

Dec. 6, 2018 (RU) ..... RU2018143158

(51) Int. Cl.
*H01P 1/20* (2006.01)
*H01P 3/12* (2006.01)
*H01Q 21/00* (2006.01)

(52) U.S. Cl.
CPC ..... *H01P 3/121* (2013.01); *H01P 1/20* (2013.01); *H01Q 21/0006* (2013.01)

(58) Field of Classification Search
CPC ..... H01P 3/121; H01P 3/122; H01P 3/123; H01P 3/14; H01P 3/12; H01P 11/002; H01P 11/007; H01P 1/207
See application file for complete search history.

(56) References Cited

U.S. PATENT DOCUMENTS 7,903,040 B2 3/2011 Gevorgian et al.
8,803,638 B2 * 8/2014 Kildal ..... H01P 1/2005 333/248
9,450,310 B2 9/2016 Bily et al.
9,608,313 B2 3/2017 Kim et al.
9,711,860 B2 7/2017 Ying et al.
9,806,393 B2 10/2017 Kildal et al.
(Continued)

FOREIGN PATENT DOCUMENTS

CN 102084538 6/2011
CN 106410344 2/2017
(Continued)

OTHER PUBLICATIONS

International Search Report dated Mar. 23, 2020 issue in counterpart application No. PCT/KR2019/017019, 11 pages.
(Continued)

*Primary Examiner* — Seokjin Kim
(74) *Attorney, Agent, or Firm* — The Farrell Law Firm, P.C.

(57) ABSTRACT

Disclosed is a ridge guide waveguide including a conductive base, a conductive ridge protruding upward from the conductive base and extending along a predetermined wave transmission direction, an upper conductive wall located over the conductive base and the conductive ridge and spaced apart from the conductive ridge by a gap, and an electromagnetic bandgap structure arranged adjacent to the conductive ridge between the conductive base and the upper conductive wall.

21 Claims, 23 Drawing Sheets

(56) References Cited

U.S. PATENT DOCUMENTS

| | | | | |
|---|---|---|---|---|
| 9,997,842 | B2 | 6/2018 | Kirino et al. | |
| 10,992,056 | B2 * | 4/2021 | Kamo | H01Q 13/22 |
| 2010/0123619 | A1 | 5/2010 | Shijo et al. | |
| 2011/0181373 | A1 | 7/2011 | Kildal | |
| 2012/0146881 | A1 | 6/2012 | McKinzie | |
| 2012/0212375 | A1 | 8/2012 | Depree, IV | |
| 2013/0088396 | A1 | 4/2013 | Han | |
| 2013/0241791 | A1 | 9/2013 | Anderson et al. | |
| 2014/0043189 | A1 | 2/2014 | Lee et al. | |
| 2015/0035714 | A1 | 2/2015 | Zhou | |
| 2015/0222014 | A1 | 8/2015 | Stevenson et al. | |
| 2015/0222021 | A1 | 8/2015 | Stevenson et al. | |
| 2016/0322708 | A1 | 11/2016 | Tayfeh Aligodarz et al. | |
| 2017/0047658 | A1 | 2/2017 | Ying et al. | |
| 2017/0084971 | A1 | 3/2017 | Kildal et al. | |
| 2017/0141479 | A1 | 5/2017 | Apostolos et al. | |
| 2018/0159203 | A1 | 6/2018 | Baks et al. | |
| 2020/0036102 | A1 * | 1/2020 | Kamo | H01P 3/123 |
| 2021/0305667 | A1 * | 9/2021 | Bencivenni | H01P 1/208 |

FOREIGN PATENT DOCUMENTS

| | | |
|---|---|---|
| CN | 106537682 | 3/2017 |
| CN | 107331974 | 11/2017 |
| CN | 107565225 | 1/2018 |
| CN | 107925168 | 4/2018 |
| EP | 2 945 222 | 11/2015 |
| KR | 101090857 | 12/2011 |
| KR | 1020130037083 | 4/2013 |
| RU | 2 590 937 | 7/2016 |
| WO | WO 2018/190794 | 10/2018 |
| WO | WO 2018/209422 | 11/2018 |

OTHER PUBLICATIONS

Russian Search Report dated May 15, 2019 issue in counterpart application No. RU 2018143158/28.

Russian Decision on Grant dated May 28, 2019 issued in counterpart application No. RU 2018143158/28.

Bayat-Makou, Nima et al., "Contactless Air-Filled Substrate Integrated Waveguide", IEEE Transactions on Microwave Theory and Techniques, Copyright 2018 IEEE, pp. 8.

Seyed Ali Razavi et al., "2×2-Slot Element for 60-GHz Planar Array Antenna Realized on Two Double-Sided PCBs Using SIW Cavity and EBG-Type, Soft Surface fed by Microstrip-Ridge Gap WaveGuide", IEEE Transactions on Antennas and Propagation, vol. 62, No. 9, Sep. 1, 2014, 10 pages.

Abhishek Sahu et al., "A Slot Antenna Designed in Ridge Gap Waveguide Technology for V-band Applications", IEEE MTT-S International Microwave, and RF Conference (IMARC), Dec. 10, 2015, 3 pages.

Yujian Li et al., "Low-Cost High-Gain and Broadband Substrate-Integrated-Waveguide-Fed Patch Antenna Array for 60-GHz Band", IEEE Transactions on Antennas and Propagation, vol. 62, No. 11, Nov. 2014, 8 pages.

European Search Report dated Dec. 14, 2021 issue in counterpart application No. 19894080.1-1205, 12 pages.

Chinese Office Action dated Feb. 7, 2023 issue in counterpart application No. 201980080546.3, 25 pages.

* cited by examiner

RIDGE GAP WAVEGUIDE AND MULTILAYER ANTENNA ARRAY INCLUDING THE SAME

CROSS-REFERENCE TO RELATED APPLICATIONS

This application is based on and claims priority under 35 U.S.C. § 119 to Russian Patent Application No. 2018143158, filed on Dec. 6, 2018, in the Russian Patent Office, the entire disclosure of which is incorporated herein by reference.

BACKGROUND

1. Field

The disclosure relates generally to wireless engineering, and more particularly, to a multilayer millimeter-wave antenna array based on a printed circuit board and a ridge gap waveguide (RGW).

2. Description of Related Art

There is an ever-increasing user demand for rapid development of communication technology. Currently, actively developed systems using communication in millimeter-wave bands include data transmission systems operating in 28 gigahertz (GHz) and 60 GHz bands, long-distance wireless power transmission (LWPT) systems operating in fifth generation (5G), wireless gigabit (WiGig), and industrial, scientific, and medical (ISM) 24 GHz bands, and automotive radar systems operating in 24 GHz and 79 GHz bands. All of these and similar systems require simple and reliable components that are efficient, functional, and suitable for mass production. Among these components, an antenna occupies an important position. The requirements for millimeter-wave antennas include low antenna loss, high gain, flexible beam control function (wide-angle beam steering and focusing), and simple, inexpensive, compact, and repeatable hardware designs that may be applied to mass production.

When considering the functional requirements thereof, the most suitable method is to use an antenna array. However, when an existing antenna array architecture is applied to a millimeter-wave band, it is too expensive (active antenna) in mass production or too large and requires an electrical contact between other portions of a waveguide-based antenna. Thus, millimeter-wave antenna arrays designed by using legacy architectures are mainly suitable for the defense and aerospace industries due to their high cost and large size.

One of the main limitations of known solutions is that the antenna efficiency decreases significantly as frequency increases, which is due to weak electromagnetic characteristics of existing materials previously used in microwave systems and the loss increase in feeding circuits. This limitation increases much more because the antenna size increases as the complexity increases to handle a large loss, and the size increase is not an optimal solution based on the above requirements.

In order to find a tradeoff relationship between the complexity and the loss level, antenna structures based on other known types of waveguides may be considered, the main parameters of which are summarized in Table 1, as follows.

TABLE 1

| Architecture | Size mm × mm | Loss tangent and dielectric constant of substrate | Material Roughness | Loss (dB/cm at 24 GHz) |
|---|---|---|---|---|
| Air-filled rectangular waveguide (FIG. 1A) | 8 × 2.5 | 1.0<br>0 | Copper<br>5 μm | 0.0085 |
| Dielectric-filled rectangular waveguide | 5 × 2.5 | 2.50<br>0.0015 | Copper<br>5 μm | 0.069 |
| Substrate integrated waveguide (SIW) (FIG. 1B) | 5 × 2.5 | 2.50<br>0.0015 | Copper<br>5 μm | 0.111 |
| Microstrip line | 0.45 × 0.203 | 3.55<br>0.003 | Copper<br>5 μm | 0.3-0.4 |
| PCB-based RGW (FIG. 1C) | 3.2 × 2.5 | 2.50<br>0.0015 | Copper<br>5 μm | 0.083 |
| Metal electromagnetic bandgap (EBG) structure-based RGW (FIG. 1D) | 3.4 × 3.7 | 1.0<br>0 | Copper<br>5 μm | 0.05 |
| Rectangular waveguide with EBG wall (Kishk) | 8 × 2.5 | 1.0<br>0 | Copper<br>5 μm | 0.03 |

FIG. 1A illustrates an air-filled waveguide 10, FIG. 1B illustrates a substrate integrated waveguide (SIW) 12, FIG. 1C illustrates a PCB-based RGW 14 and FIG. 1D illustrates a metal electromagnetic bandgap (EBG) structure-based RGW 18, according to the conventional art. For example, an air-filled waveguide 10 of FIG. 1A, as indicated above in Table 1, is too bulky to apply to an antenna array because its width is comparable to the distance between antenna elements. Furthermore, a typical air-filled waveguide is very sensitive to the contact of metal components. That is, when there is incorrect contact between the antenna components, an additional loss may occur due to leakage, as illustrated in FIG. 2A. An antenna manufactured by using a multilayer printed circuit board requires particular accuracy, but an additional loss tends to occur. Thus, in many millimeter-wave devices, a structure capable of contactless coupling with a waveguide element is preferred.

However, all metal waveguides with an electromagnetic bandgap structure restricted by milling performance. In other words, in order to ensure allowable device characteristics, it is necessary to manufacture an EBG waveguide element with high accuracy. In case of example waveguides 22 and 24 of conventional art, as illustrated in FIGS. 2B and 2C, for propagation only along a solid arrow direction and no propagation along a dotted arrow direction, thin milling work is required.

Thus, existing architectural solutions for generating antenna arrays are not suitable for millimeter-wave systems under development.

For example, there are waveguide structures known from the related art implemented by a narrow gap between two parallel conductive surfaces by using a multilayer structure at one of textures or surfaces, as taught in U.S. Pat. No. 9,806,393 and U.S. Publication No. 2017/0084971, both to Kildal et al. These structures employ thin milling that requires very high complexity, and excessive manufacturing time and cost.

Other technical solutions include "Contactless Air-Filled Substrate Integrated Waveguide" to Kishik et al, which introduced a contactless alternative to an air-filled substrate integrated waveguide (AF-SIW), as seen above in Table 1.

FIGS. 3A and 3B illustrate contactless AF-SIW waveguides according to the conventional art. The AF-SIW configuration requires the accurate and flawless connection of a coating layer to an intermediate substrate, which is complex in design and expensive to manufacture for efficient operation at high frequencies. As illustrated in FIGS. 3A and 3B, a waveguide includes an upper conductive layer 30 and lower conductive layer 32 between the upper and lower conductive layers 30 and 32, and a printed circuit board 36 is at a side portion thereof. The upper and lower layers of the internal printed circuit board are modified to achieve artificial magnetic conductor (AMC) 38 conditions. The AMC surfaces on both sides of the waveguide substrate are formed in a periodic structure with a particular type of unit cell. The formed AMC plate located in the substrate region parallel to the conductive layer prevents leakage to outside the waveguide. The width of the waveguide is about $\lambda/2$, but it is very difficult to make an antenna array at intervals of $\lambda/2$.

Thus, there is a need for an antenna array that eliminates the limitations of the existing solutions, such as high loss, large size, high manufacturing complexity, and strong dependence on the quality of the contact between components having conductivity.

SUMMARY

The disclosure addresses at least the above-mentioned problems and/or disadvantages and to provide at least the advantages described below.

Accordingly, an aspect of the disclosure is to provide an RGW that cures the losses and design complexities of the prior art structures.

Another aspect of the disclosure is to provide a millimeter-wave-band multilayer antenna array using the improved RGW disclosed herein.

In accordance with an aspect of the disclosure, an RGW includes a conductive base, a conductive ridge protruding upward from the conductive base and extending along a predetermined wave transmission direction, an upper conductive wall located over the conductive base and the conductive ridge and spaced apart from the conductive ridge by a gap, and an EBG structure arranged adjacent to the conductive ridge between the conductive base and the upper conductive wall.

The EBG structure may be spaced apart from at least one of the conductive base or the upper conductive wall by an air gap.

The ridge gap waveguide may further include a spacer arranged in at least one of a position between the EBG structure and the conductive base and a position between the EBG structure and the upper conductive wall fixing the EBG structure and providing an air gap in at least one of a position between the EBG structure and the conductive base and a position between the EBG structure and the upper conductive wall.

The spacer may include a shape protruding toward the EBG structure from an upper surface of the conductive base or a lower surface of the upper conductive wall. The spacer may be located not to simultaneously contact adjacent cells that are included in the EBG structure and are adjacent to each other.

The EBG structure may include a plurality of cells that are arranged in a two-dimensional periodic lattice structure and are not electrically coupled to each other, and wherein each of the plurality of cells may include: a dielectric layer; a first conductive pattern and a second conductive pattern respectively formed at a lower surface and an upper surface of the dielectric layer; and a conductive via passing through the dielectric layer and connecting the first conductive pattern to the second conductive pattern.

The EBG structure may be formed based on a double-sided printed circuit board. The double-sided printed circuit board may include a concave portion, and wherein the conductive ridge may be arranged at the concave portion.

The conductive ridge may include a pattern for filtering an electromagnetic wave of a predetermined frequency.

The ridge gap waveguide may further include an upper ridge protruding toward the conductive ridge from the upper conductive wall and maintaining a distance from the conductive ridge.

In accordance with another aspect of the disclosure, an antenna array includes a conductive base, a conductive ridge protruding upward from the conductive base, extending along a predetermined wave transmission direction, and connected to an input port, an EBG structure arranged adjacent to the conductive ridge over the conductive base, and an SIW resonator arranged over the conductive ridge and the EBG structure and including a lower conductive layer spaced apart from the conductive ridge by a gap and forming a waveguide with the conductive ridge, and an upper conductive layer forming a resonant cavity with the lower conductive layer.

The EBG structure may include a plurality of cells that are arranged in a two-dimensional periodic lattice structure and are not electrically coupled to each other, and wherein each of the plurality of cells may include: a first dielectric layer; a first conductive pattern and a second conductive pattern respectively formed at a lower surface and an upper surface of the first dielectric layer; and a conductive via passing through the first dielectric layer and connecting the first conductive pattern to the second conductive pattern.

The EBG structure may be formed based on a first double-sided printed circuit board.

The SIW resonator may include: an input layer including the lower conductive layer and an input slot; an output layer including the upper conductive layer and an output slot; and an intermediate layer including: a second dielectric layer arranged between the input layer and the output layer; and a plurality of conductive elements connecting the input layer to the output layer and forming a sidewall of the resonant cavity.

The conductive element may include a metallic via passing through the second dielectric layer.

The SIW resonator may be formed based on a second double-sided printed circuit board.

A distance between the plurality of conductive elements may be set to prevent a power leakage to outside from the SIW resonator.

The antenna array may further include an additional conductive element located in the resonant cavity and used for matching with the SIW resonator.

The antenna array may further include a radiator arranged over the SIW resonator and including a conductive patch facing the output slot.

The antenna array may further include a spacer located between the radiator and the SIW resonator and providing an air gap between the radiator and the SIW resonator.

The input port may be located at a center portion of the waveguide formed by the conductive ridge and the lower conductive layer.

The input slot included in the SIW resonator may include a plurality of input slots, and the conductive ridge may include a shape that distributes power to the plurality of input slots at equal amplitude and phase.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1A:
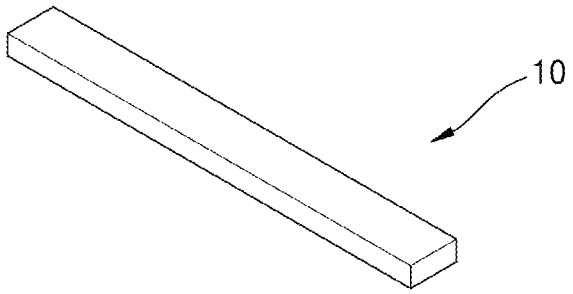
FIGS. 1A, 1B, 1C and 1D illustrate schematic shapes of waveguides for millimeter wave bands according to the conventional art.
Figure 1B:
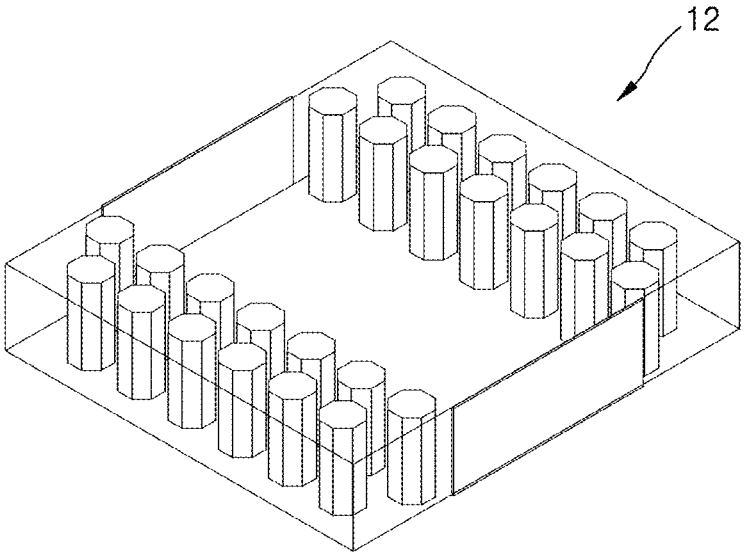
Figure 1C:
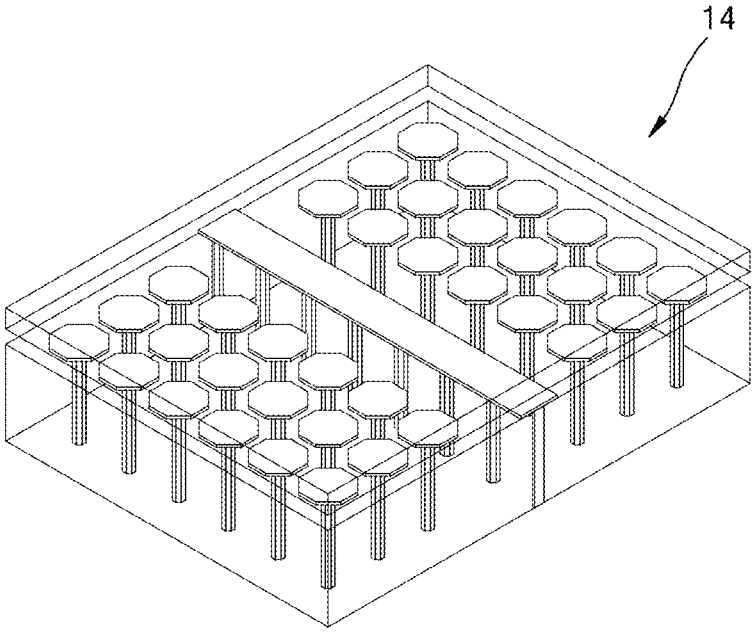
Figure 1D:
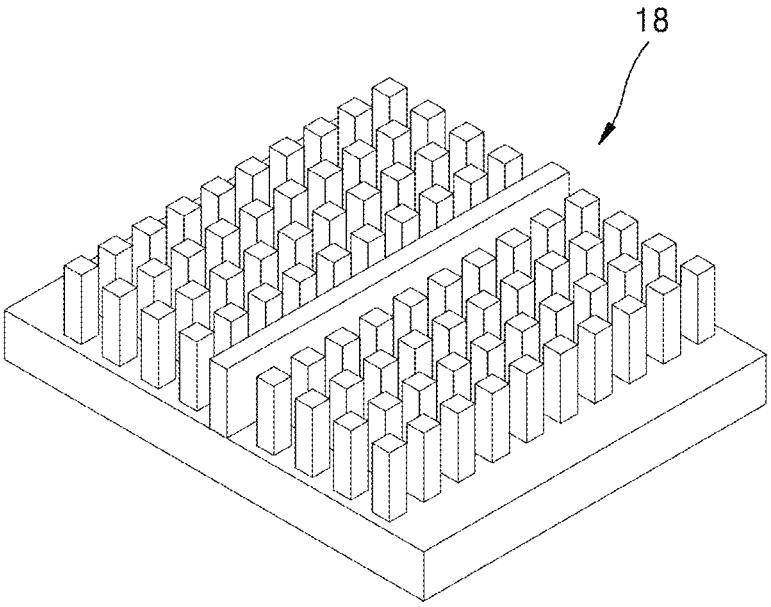
Figure 2A:
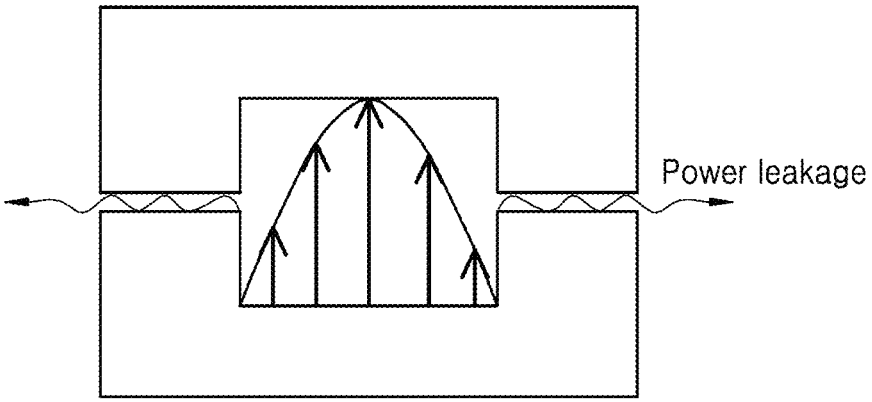
FIGS. 2A, 2B and 2C illustrate characteristics of waveguides according to the conventional art.
Figure 2B:
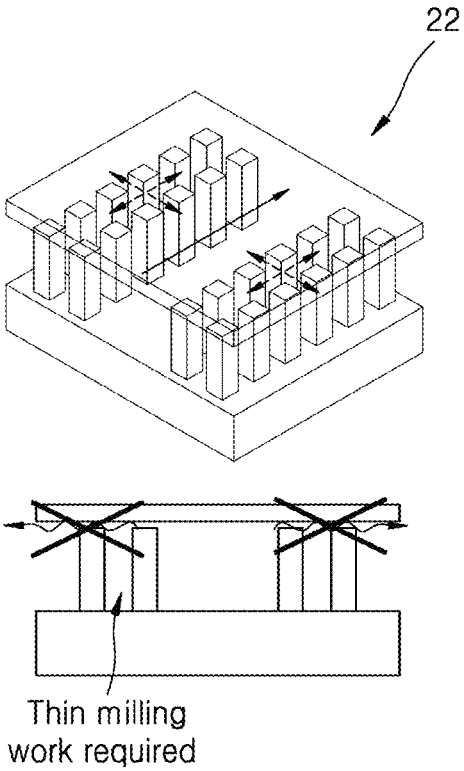
Figure 2C:
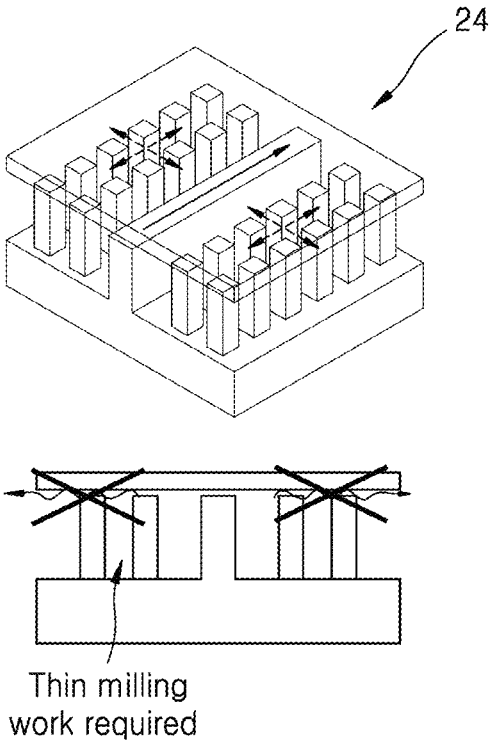
Figure 3A:
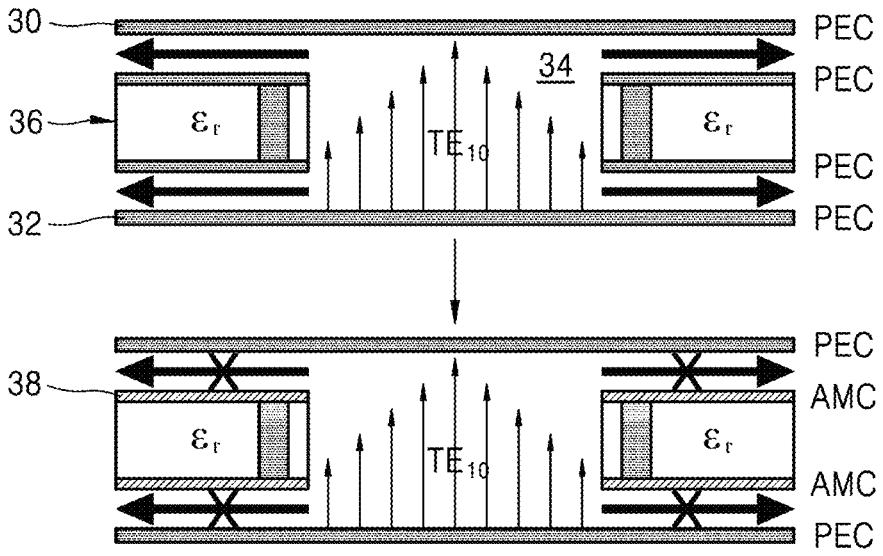
FIGS. 3A and 3B illustrate contactless AF-SIW waveguides according to the conventional art.
Figure 3B:
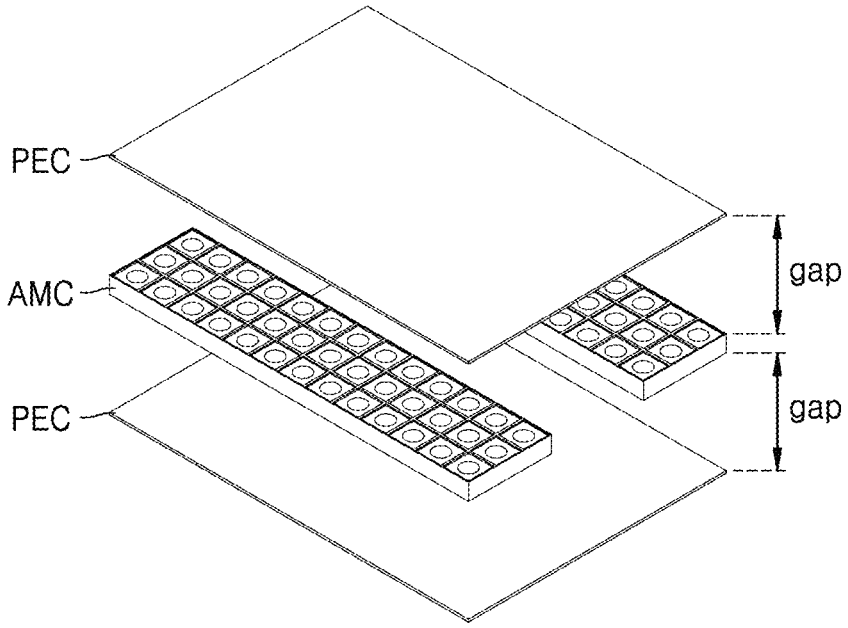

Embodiments of the disclosure will be described in detail with reference to the accompanying drawings. In the drawings, like reference numerals may denote like elements, and the size of each element may be exaggerated convenience of description. In addition, descriptions of well-known functions and constructions may be omitted for the sake of clarity and conciseness.

Terms such as "first", "second", and "third" may be used herein to describe various elements, components, regions, layers, and/or sections which should not be limited by these terms. These terms are only used to distinguish one element, component, region, layer, or section from another element, component, region, layer, or section. Thus, a first element, component, region, layer, or section may be referred to as a second element, component, region, layer, or section without departing from the scope of the disclosure. As used herein, the expression "and/or" includes any and all combinations of one or more of the associated listed items. A component referred to in the singular does not exclude a plurality of components unless otherwise specified.

Throughout the disclosure, the expression "at least one of a, b, or c" indicates only a, only b, only c, both a and b, both a and c, both b and c, all of a, b, and c, or variations thereof.

As used herein, the terms "over" or "on" may include not only "directly over" or "directly on" but also "indirectly over" or "indirectly on".

As used herein, the singular forms "a", "an", and "the" are intended to include the plural forms as well, unless the context clearly indicates otherwise. Also, when something is referred to as "including" a component, another component may be further included unless specified otherwise.

Figure 4:
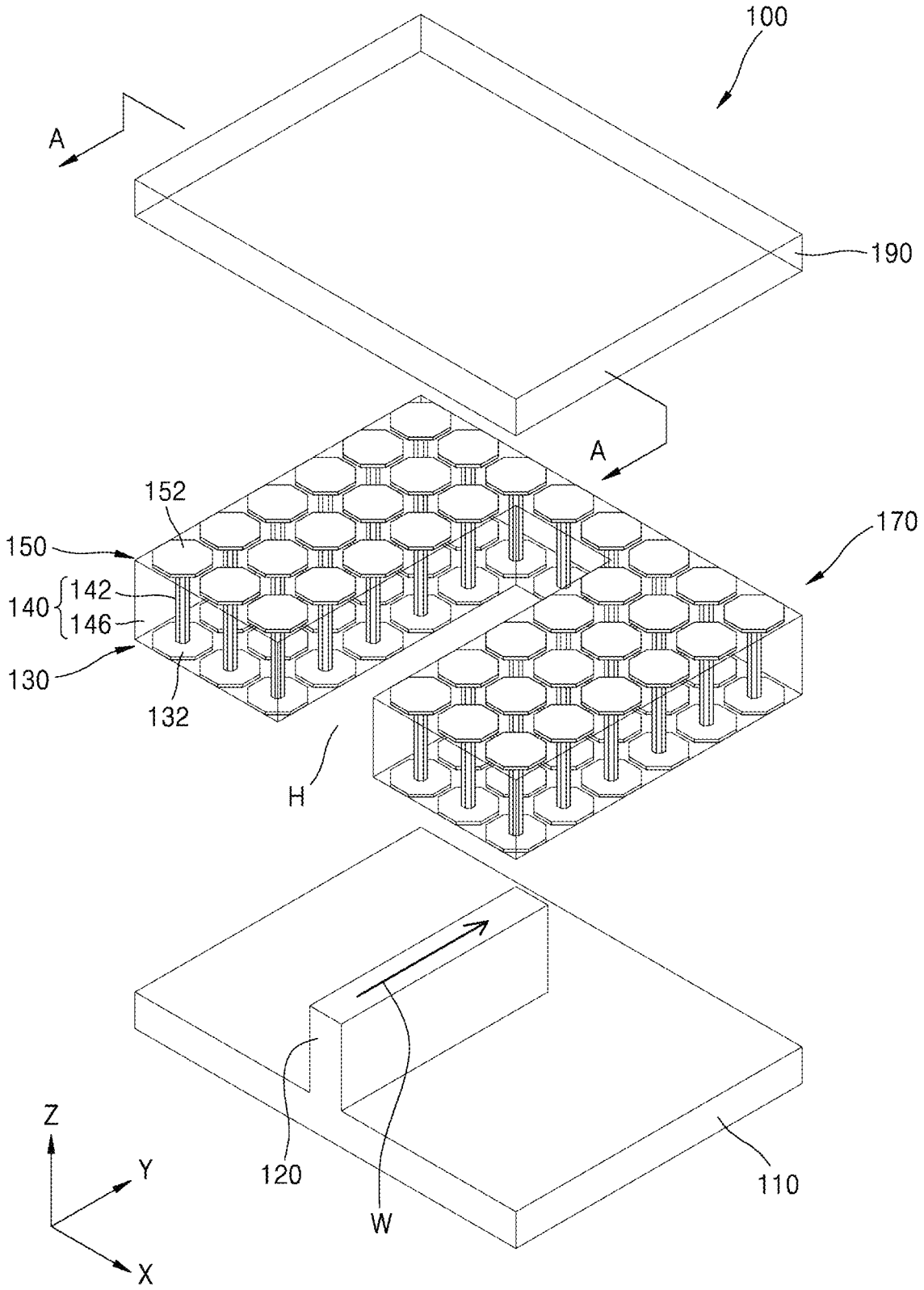
FIG. 4 is an exploded perspective view illustrating a schematic structure of an RGW according to an embodiment.

FIG. 4 illustrates a schematic structure of an RGW according to an embodiment.

Referring to FIG. 4, an RGW 100 includes a conductive base 110, a conductive ridge 120 protruding upward from the conductive base 110 and extending along a predetermined wave transmission direction, an upper conductive wall 190 located over the conductive base 110 and the conductive ridge 120 and spaced apart from the conductive ridge 120 by a gap, and an EBG structure 170 arranged adjacent to the conductive ridge 120 between the conductive base 110 and the upper conductive wall 190.

The conductive ridge 120 may extend along an electromagnetic wave propagation direction W. Although the conductive ridge 120 is illustrated in a linear shape along the Y direction in FIG. 4, the conductive ridge 120 is not limited thereto and may have a shape extending along a desired propagation path.

The upper conductive wall 190 may be arranged spaced apart from the conductive ridge 120 by a gap, and a space (labeled as 125 in FIG. 5) between the conductive ridge 120 and the upper conductive wall 190 may be provided as an electromagnetic wave propagation path.

The EBG structure 170 may be provided in the RGW 100 such that an electromagnetic wave may propagate in a desired direction and may not leak in other directions. That is, the EBG structure 170 may be arranged to fill a region around the conductive ridge 120.

The EBG structure 170 may be arranged spaced apart from the conductive ridge 120 and to surround at least a portion of the conductive ridge 120.

Figure 5:
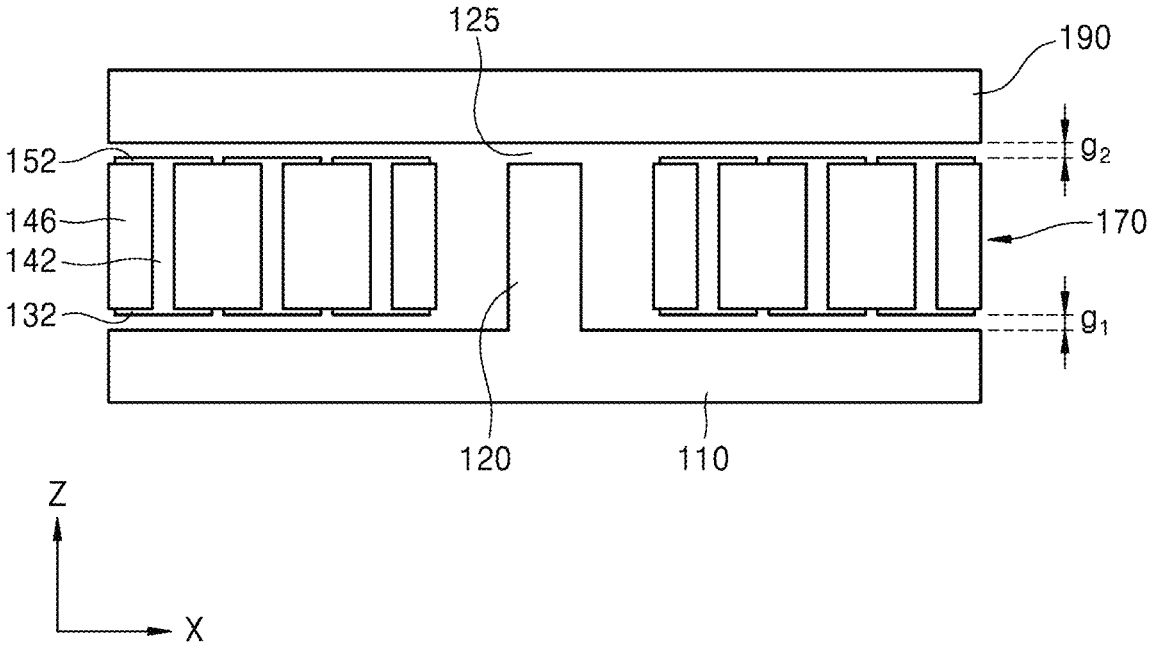
FIG. 5 is an A-A cross-sectional view of the RGW of FIG. 4.

FIG. 5 is an A-A cross-sectional view of the ridge gap waveguide of FIG. 4. As seen in FIG. 5, the EBG structure 170 may be arranged spaced apart from at least one of the conductive base 110 or the upper conductive wall 190 with an air gap $g^1$ between the EBG structure 170 and the conductive base 110. The gap between the EBG structure 170 and the upper conductive wall 190 may be $g^2$. At least one of g1 and g2 may be greater than zero. In the following drawings, both g1 and g2 may be illustrated as being greater than zero; however, the disclosure is not limited thereto and one of the gaps g1 and g2 may be zero.

The EBG structure 170 may be formed based on a double-sided printed circuit board.

Referring back to FIG. 4, the EBG structure 170 may include a first layer 130, a second layer 140, and a third layer 150. The first layer 130 may include a plurality of first conductive patterns 132 formed on a lower surface of a dielectric layer 146, and the third layer 150 may include a plurality of second conductive patterns 152 formed on an upper surface of the dielectric layer 146 and respectively corresponding to the plurality of conductive patterns 132. The second layer 140 may include a dielectric layer 146 and a conductive via 142 passing through the dielectric layer 146 to connect the first conductive pattern 132 to the second conductive pattern 152. The conductive via 142 may be a metallic via. The size or shape of the first conductive pattern 132 and the second conductive pattern 152 is not limited to the illustrated size or shape and may be selected according to the requirements for a particular application to which the RGW 100 is to be applied.

A concave portion H may be formed at the double-sided printed circuit board forming the EBG structure 170. The concave portion H may provide a space in which the conductive ridge 120 is arranged. The concave portion H may be formed at a position corresponding to the conductive ridge 120 and may have a size capable of maintaining a gap between the conductive ridge 120 and the EBG structure 170. That is, the EBG structure 170, the conductive base 110, and the conductive ridge 120 may be assembled such that the conductive ridge 120 may be arranged at the concave portion H.

Figure 6:
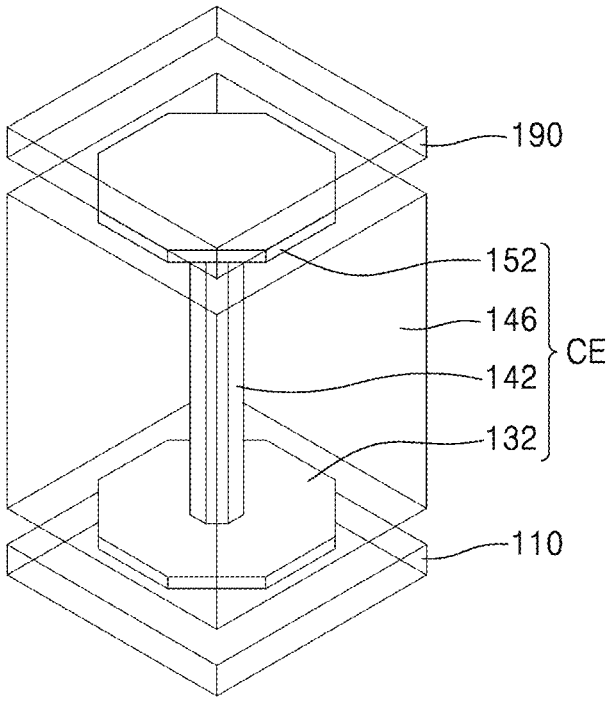
FIG. 6 illustrates a unit cell shape of an EBG structure included in the RGW of FIG. 4.

FIG. 6 illustrates a unit cell shape of an EBG structure included in the RGW of FIG. 4.

Referring to FIG. 6, the EBG structure 170 may have a shape including a plurality of cells CE that are arranged in a two-dimensional periodic lattice structure and are not electrically coupled to each other. That is, the plurality of first conductive patterns 132 on the lower surface of the dielectric layer 146 may be arranged spaced apart from each other, and the second conductive patterns 152 on the upper surface of the dielectric layer 146 may also be formed spaced apart from each other. As illustrated in FIG. 6, each of the plurality of cells CE may include a dielectric layer 146, a first conductive pattern 132 and a second conductive pattern 152 respectively formed on the lower surface and the upper surfaces of the dielectric layer 146, and a conductive via 142 passing through the dielectric layer 146 to connect the first conductive pattern 132 to the second conductive pattern 152.

The EBG structure 170 may form a bandgap in a region between the conductive base 110 and the upper conductive wall 190 in an operating frequency band to block the propagation (leakage) of a predetermined frequency band of waves to the space outside the RGW 100.

Figure 7A:
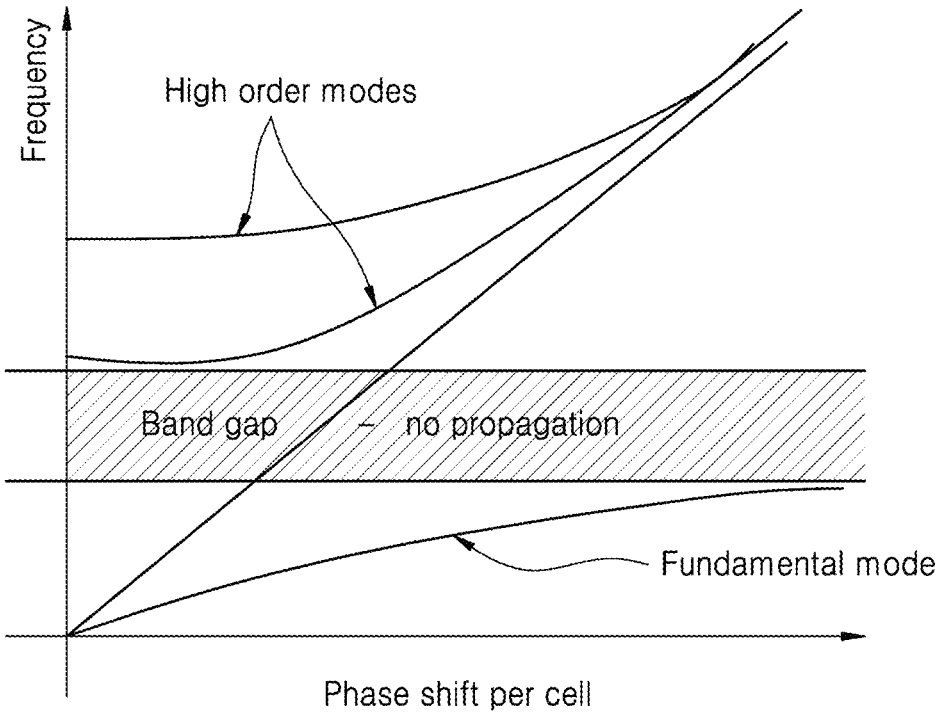
FIGS. 7A and 7B illustrate an operation of a bandgap in an RGW according to an embodiment.

FIG. 7A illustrates an operation of a bandgap in an RGW according to an embodiment.

In FIG. 7A, the frequency of a signal transmitted through the EBG structure 170 depends on the phase shift implemented in each cell. The wave propagation in this structure is nonexistent in a certain frequency range, located between two parallel lines marked on the vertical axis.

Figure 7B:
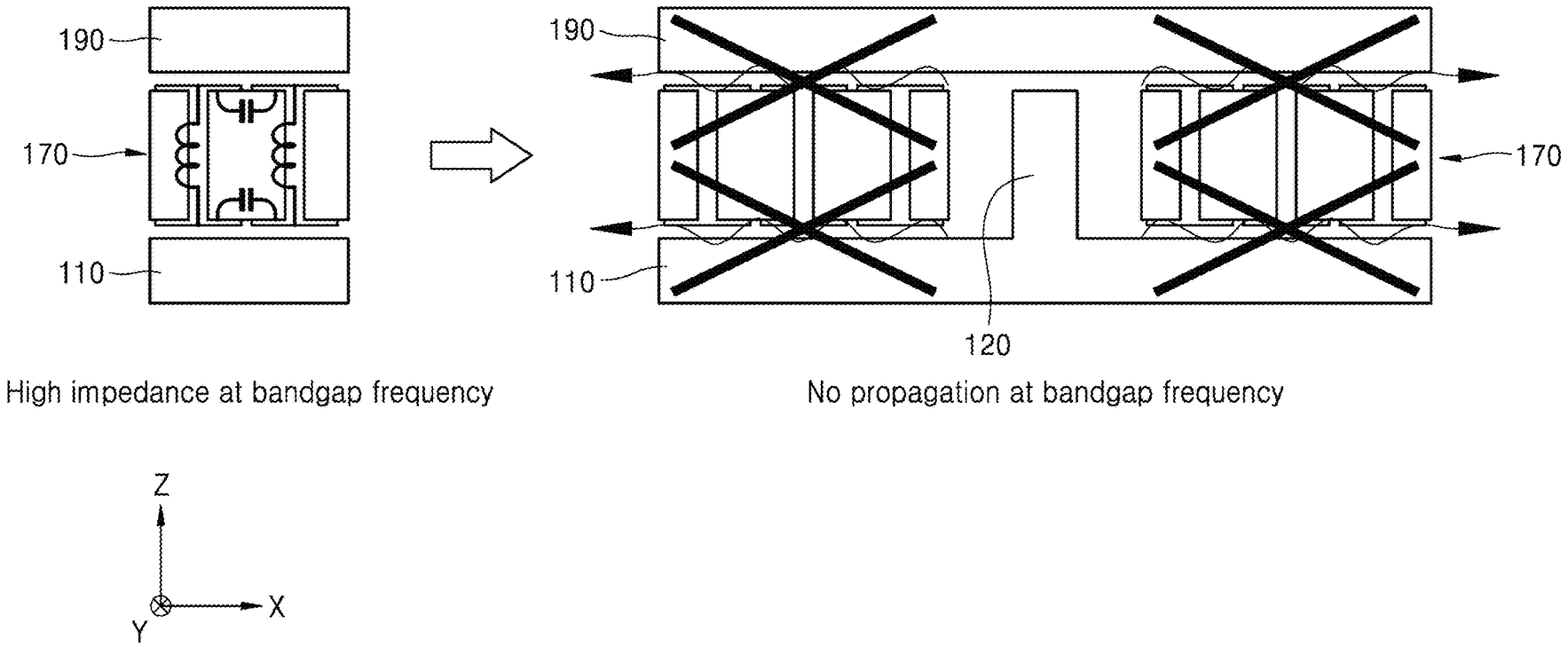

FIG. 7B illustrates an operation of a bandgap in an RGW according to an embodiment.

In FIG. 7B, at a frequency in the bandgap, the EBG structure 170 exhibits high, impedance, and thus the propagation of an electromagnetic wave hardly occurs in a region between the EBG structure 170 and the upper conductive wall 190 and a region between the EBG structure 170 and the conductive base 110. That is, the electromagnetic wave propagates along the extension direction (Y direction) of the conductive ridge 120 in a region between the conductive ridge 120 and the upper conductive wall 190 and does not propagate in other directions.

Figure 8:
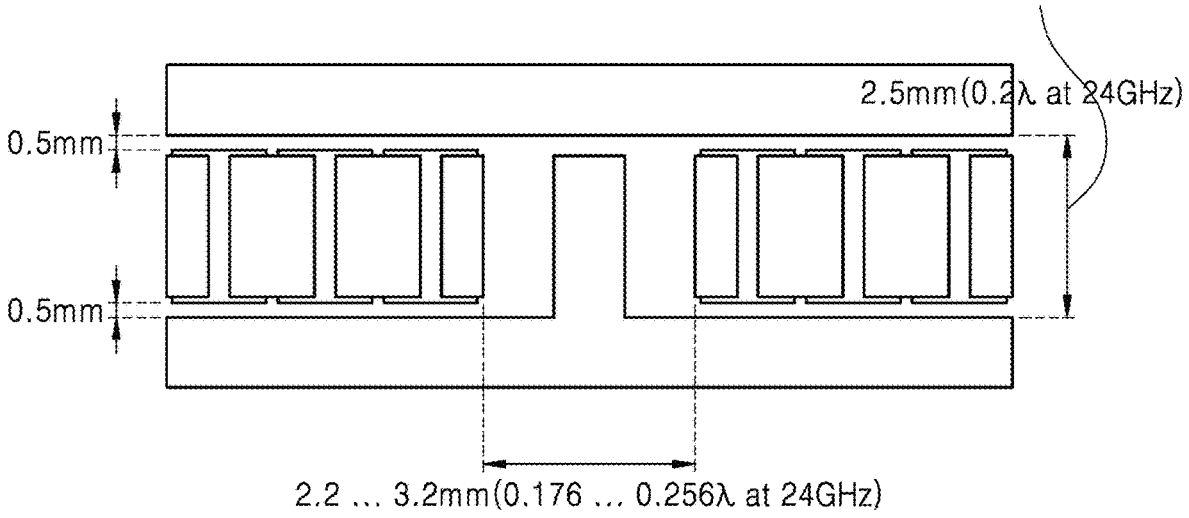
FIG. 8 illustrates an example dimension of an RGW according to an embodiment.

FIG. 8 illustrates an example dimension of the RGW 100 according to an embodiment.

As illustrated in FIG. 8, some dimensions of the RGW 100 are shown may provide high performance. These dimensions are for an operating frequency of about 2.4 GHz; when an air gap between the EBG structure 170 and the conductive base 110 and an air gap between the EBG structure 170 and the upper conductive wall 190 are about 0.5 mm, a distance between adjacent EBG structures 170 arranged with the conductive ridge 120 therebetween is about 2.2 mm to about 3.2 mm (corresponding to about 0.176 to about 0.256 of the wavelength), a distance between the conductive base 110 and the upper conductive wall 190 is about 2.5 mm (about 0.2 of the wavelength), and an insertion loss level thereof is only about 0.06 dB/cm. That is, in this compact size, the RGW 100 in FIG. 8 may have a very low loss and may not require a strong and reliable contact between the layers in the assembly of the RGW 100.

Figure 9:
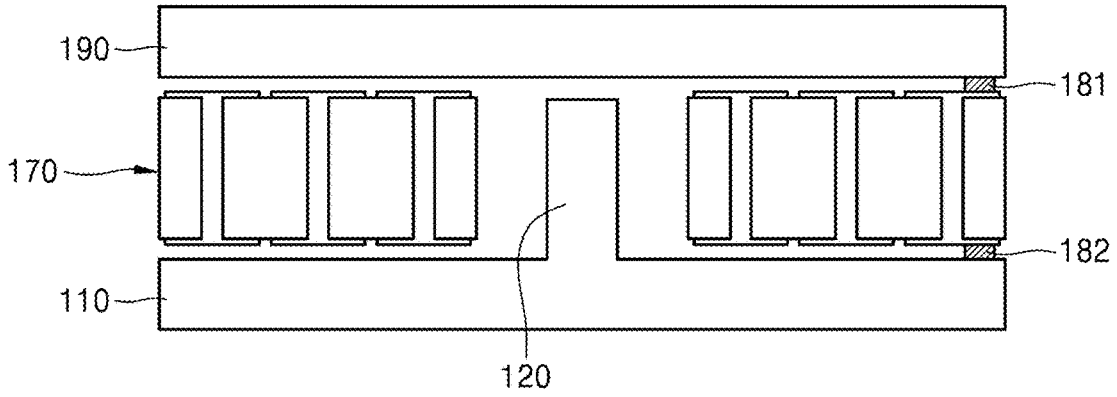
FIGS. 9 and 10 illustrate an example shape of a spacer included in an RGW according to embodiments.

FIG. 9 illustrates an example shape of a spacer that may be included in an RGW according to an embodiment.

As illustrated in FIG. 9, the RGW 100 may include spacers 181 and 182 that are arranged at at least one of a position between the EBG structure 170 and the conductive base 110 or a position between the EBG structure 170 and the upper conductive wall 190 to fix the EBG structure 170 and provide an air gap at at least one of a position between the EBG structure 170 and the conductive base 110 or a position between the EBG structure 170 and the upper conductive wall 190.

As illustrated in FIG. 9, the spacer 181 may have a shape protruding from the lower surface of the upper conductive wall 190 toward the EBG structure 170. The spacer 182 may have a shape protruding from the upper surface of the conductive base 110 toward the EBG structure 170. The spacers 181 and 182 may be pre-formed as a protrusion portion on the conductive base 110 or the EBG structure 170 or the upper conductive wall 190. The spacer 182 may be formed to protrude from the conductive base 110 toward the EBG structure 170 or to protrude from the EBG structure 170 toward the conductive base 110.

The spacer 181 may be formed to protrude from the upper conductive wall 190 toward the EBG structure 170 or to protrude from the EBG structure 170 toward the upper conductive wall 190. Although it is illustrated that the spacers 181 and 182 are both provided between the upper conductive wall 190 and the EBG structure 170 and between the EBG structure 170 and the conductive base 110, the disclosure is not limited thereto and either one thereof may be provided.

Figure 10:
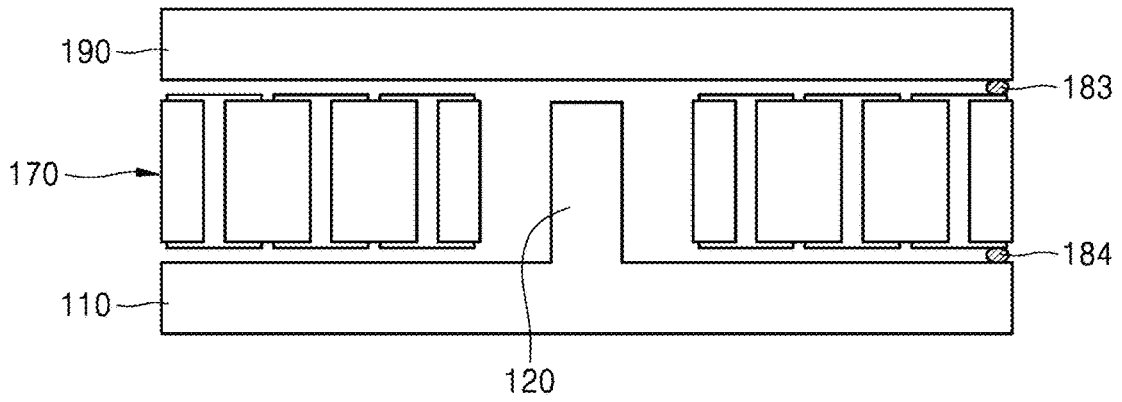

FIG. 10 illustrates an example shape of a spacer that may be included in an RGW according to an embodiment.

As illustrated in FIG. 10, the spacers 183 and 184 may be separate elements inserted between the respective layers in the manufacturing process of the RGW 100. The spacer 184 may be inserted between the conductive base 110 and the EBG structure 170, and the spacer 183 may be inserted between the EBG structure 170 and the upper conductive wall 190. Although it is illustrated that the spacers 183 and 184 are both provided between the upper conductive wall 190 and the EBG structure 170 and between the EBG structure 170 and the conductive base 110, the disclosure is not limited thereto and either one thereof may be provided.

The spacers 181, 182, 183, and 184 may be conductive or nonconductive materials, but may not make adjacent elements of the EBG structure 170 to contact with each other. The spacers 181, 182, 183, and 184 may be located not to simultaneously contact adjacent cells adjacent to each other.

The spacers 181, 182, 183, and 184 may function to form an air gap between the upper conductive wall 190 and the EBG structure 170 and/or between the EBG structure 170 and the conductive base 110, and to provide a fixing means. For example, adhesive drops may be used as the spacers 181, 182, 183, and 184 or as some components included therein. A fastening element such as a screw for fastening a structure may pass through the spacers 181, 182, 183, and 184. Alternatively, structural fixation may be performed by other means not located inside the spacers 181, 182, 183, and 184.

Figure 11A:
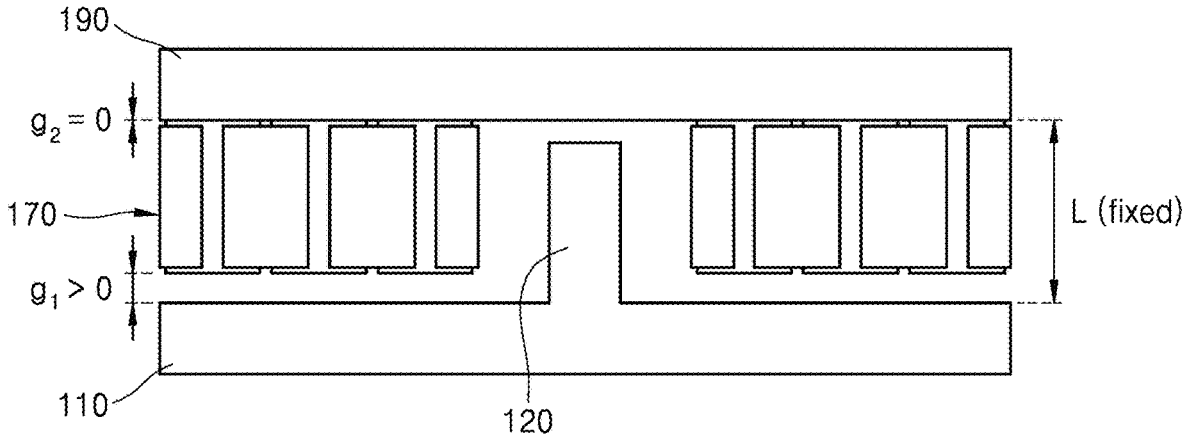
FIGS. 11A, 11B and 11C illustrate a variation range of a gap that an EBG structure forms between a lower conductive base and an upper conductive wall in an RGW according to an embodiment.
Figure 11B:
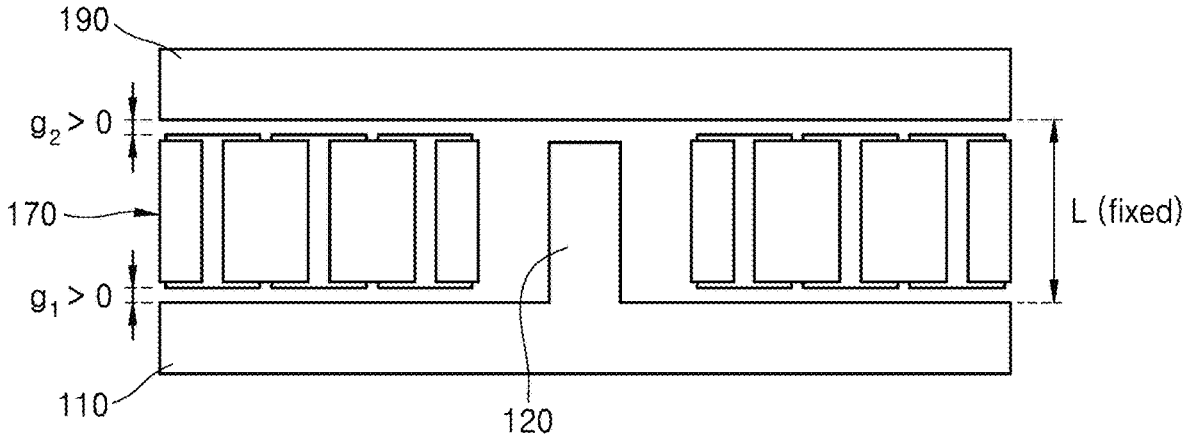
Figure 11C:
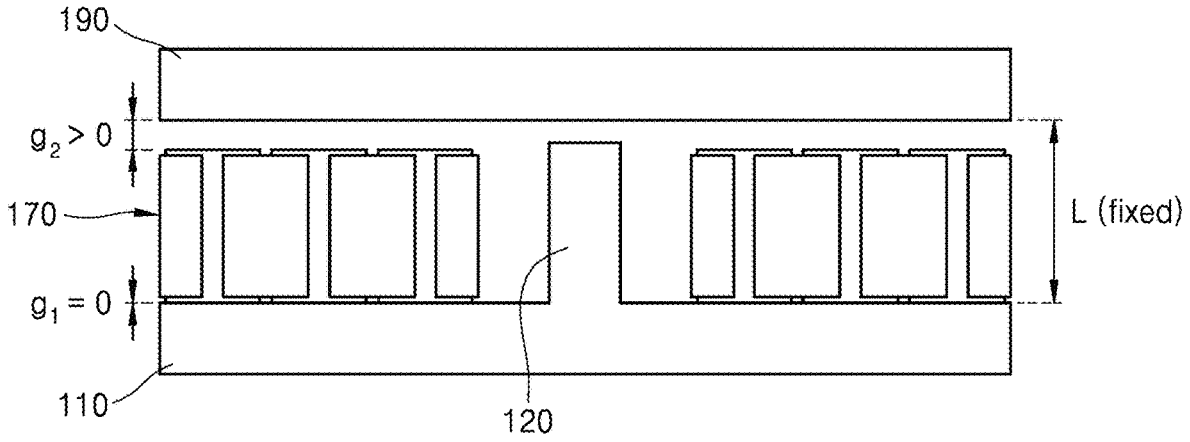

FIGS. 11A, 11B and 11C illustrate a variation range of a gap that an EBG structure forms between a lower conductive base and an upper conductive wall in an RGW according to embodiments.

The RGW 100 is provided with a gap between the EBG structure 170 and the conductive base 110 and/or a gap between the EBG structure 170 and the upper conductive wall 190 for optimal performance. The size of these gaps may vary in a considerable range.

Figure 12A:
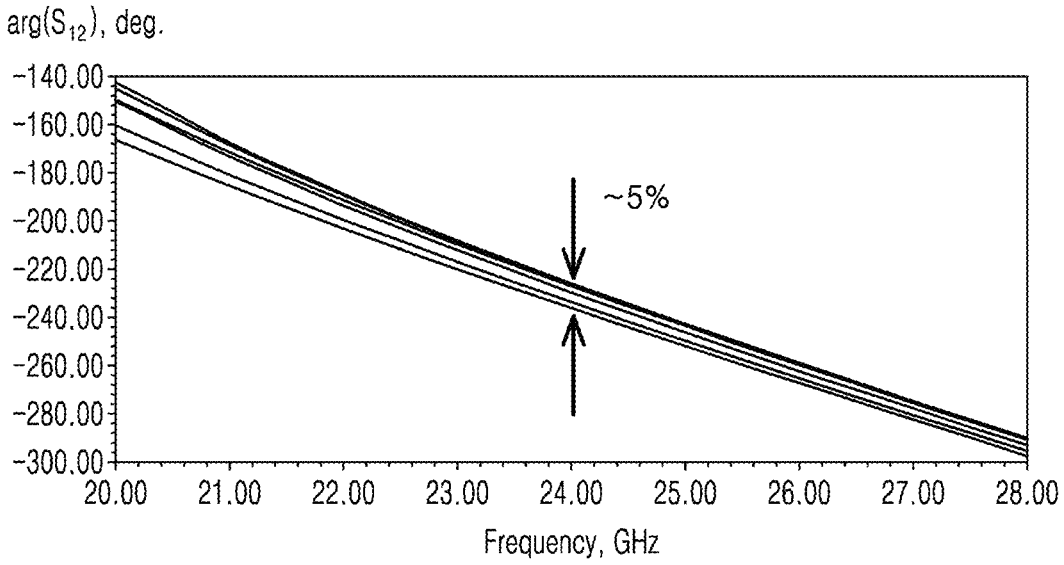
FIGS. 12A and 12B illustrate a variation range of an S parameter depending on an air gap size of an RGW according to embodiments.
Figure 12B:
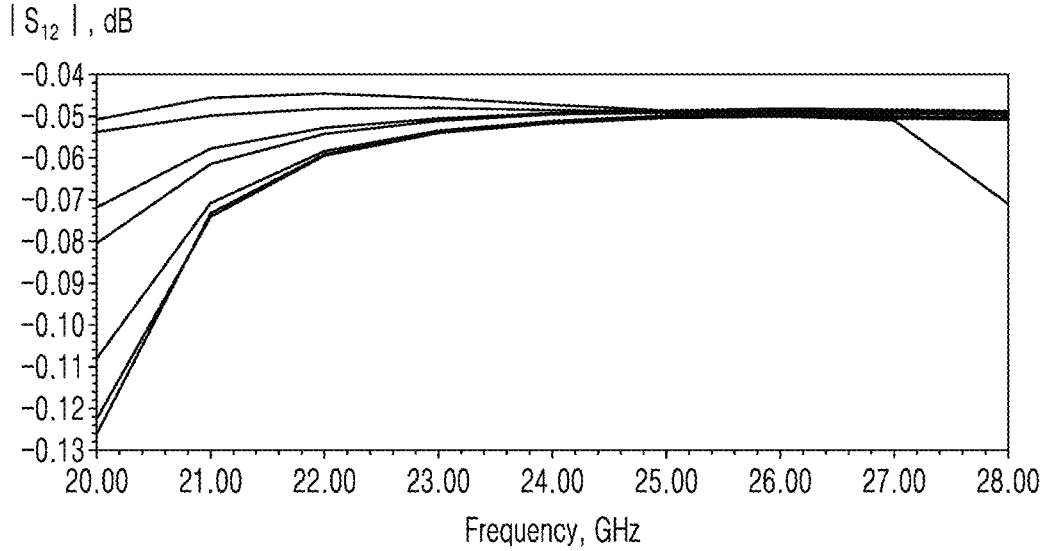

FIGS. 12A and 12B illustrate a variation range of an S parameter depending on an air gap size of an RGW according to embodiments.

As illustrated in FIGS. 12A to 12B, a change in the air gap size does not significantly affect the performance of the RGW 100 as a whole in terms of an electrical length or a transmission coefficient. That is, in the variation range of g1 and g2 when the EBG structure 170 contacts the upper conductive wall 190 as illustrated in FIG. 11A, when an air gap is formed on both the upper and lower sides of the EBG structure 170 as illustrated in FIG. 11B, and when the EBG structure 170 contacts the conductive base 110 as illustrated in FIG. 11C, the variation range of the S-parameter is about 5%. As such, the disclosed structure of the RGW 100 is versatile and has a large tolerance range, thereby requiring less high-precision manufacturing.

FIGS. 13A, 13B, 13C and 13D illustrate various shapes of an EBG structure that may be used in an RGW according to embodiments.

Figure 13A:
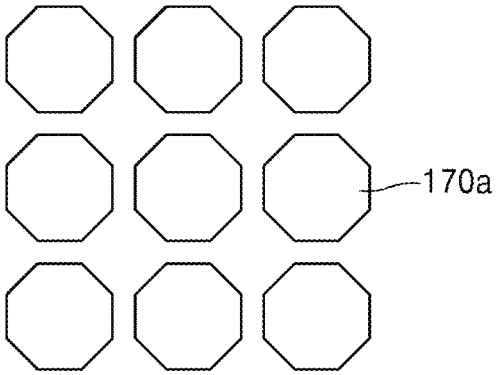
FIGS. 13A, 13B, 13C and 13D illustrate various shapes of an EBG structure that may be used in an RGW according to embodiments.
Figure 13B:
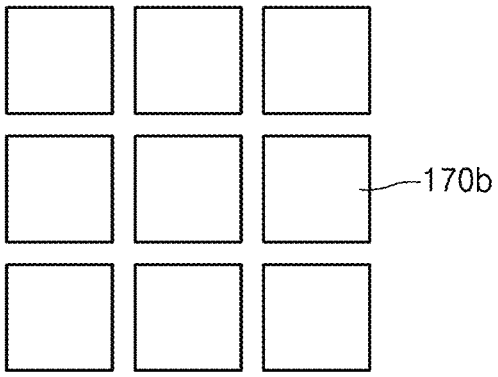
Figure 13C:
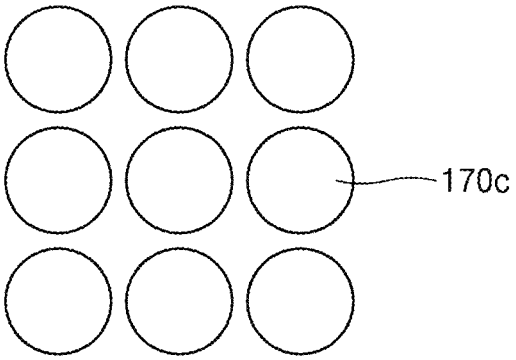
Figure 13D:
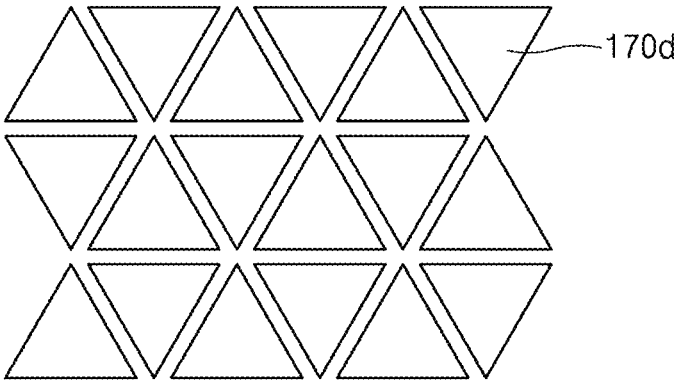

As described above, the size, shape, and position of conductive portions provided in the EBG structure 170 may be selected according to the requirements for a particular application. Various particular examples of the cells are illustrated in FIGS. 13A, 13B, 13C and 13D. As illustrated in. FIG. 13A, the conductive portions of the EBG structure cell may be formed in the shape of octagons 170*a*. As illustrated in FIG. 13B, the conductive portions of the EBG structure cell may be formed in the shape of squares 170*b*. As illustrated in FIG. 13C, the conductive portions of the EBG structure cell may be formed in the shape of circles 170*c*. As illustrated in FIG. 13D, the conductive portions of the EBG structure cell may be formed in the shape of triangles 170*d*.

The concept of forming the size of an electromagnetic crystal structure is known to those or ordinary skill in the art, and thus, will not be described in detail herein. The electromagnetic crystal structure should be periodic. The lattice may be square, rectangular, triangular, or the like. Because the cell arrangement and cell shape of the EBG structure 170 may be flexibly adjusted, the required electrical performance thereof may be conveniently adjusted, and the EBG structure 170 may be simply used in the internal structure of a device in which the RGW 100 is to be used.

Figure 14:
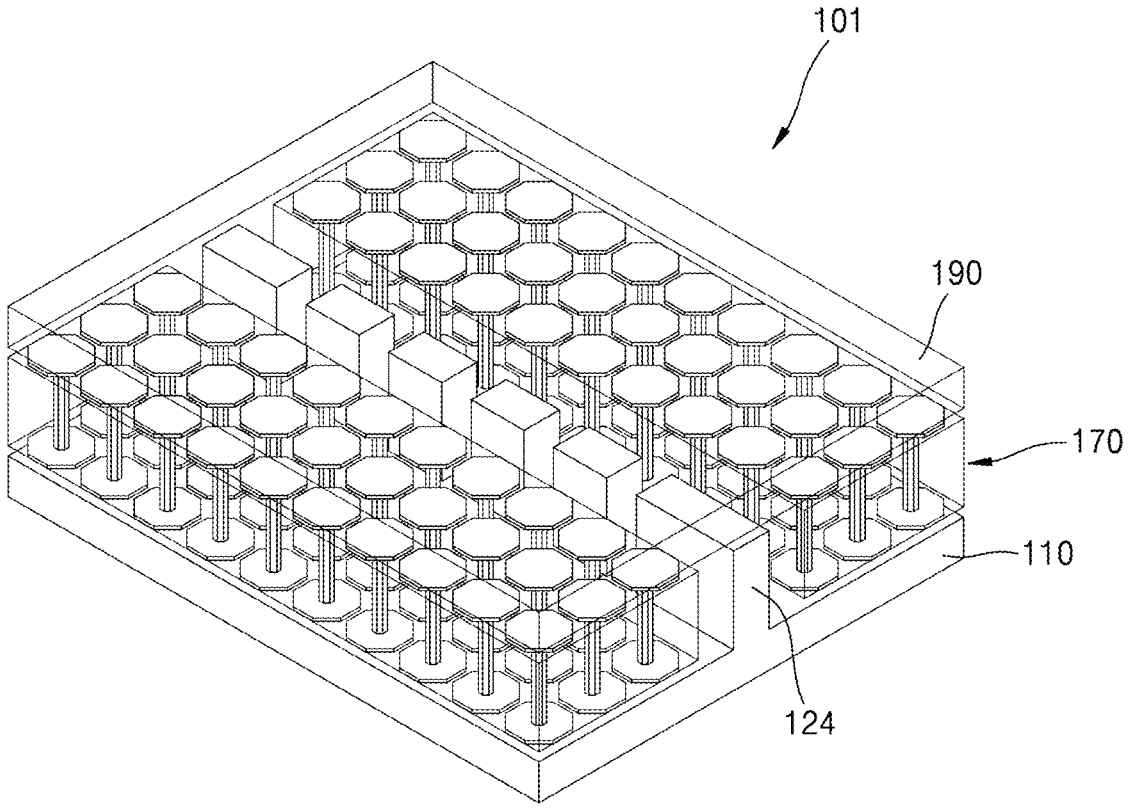
FIG. 14 illustrates a schematic structure of an RGW according to an embodiment.

FIG. 14 illustrates a schematic structure of an RGW according to an embodiment. An RGW 101 is different from the RGW 100 of FIG. 1 in the shape of a conductive ridge 124. The conductive ridge 124 may have a pattern for filtering an electromagnetic wave of a predetermined frequency. However, the illustrated pattern is merely an example and the disclosure is not limited thereto. For example, the conductive ridge 124 may include a surface corrugation and various curved shapes. Alternatively, resonant pins may be located along the conductive ridge 124. This ridge gap waveguide 101 may be used as a component of an antenna or may be applied as an individual filter for the required frequency.

Figure 15:
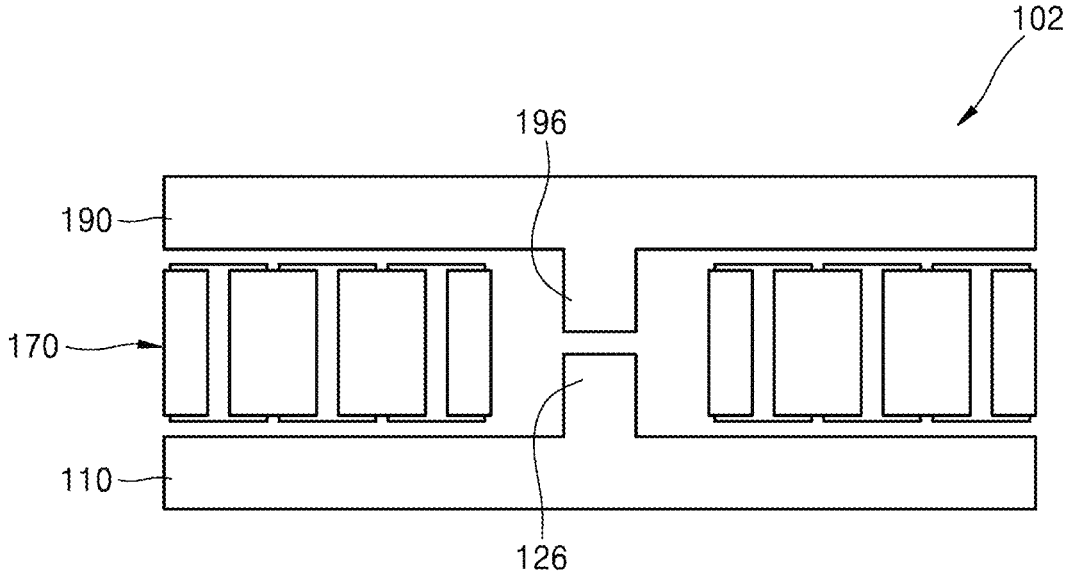
FIG. 15 illustrates a schematic structure of an RGW according to an embodiment.

FIG. 15 illustrates a schematic structure of an RGW according to an embodiment. An RGW 102 in FIG. 15 is different from the RGW 100 of FIG. 1 in that it further includes an upper ridge 196 protruding from the upper conductive wall 190 toward a conductive ridge 126 thereunder in addition to the conductive ridge 126 protruding from the conductive base 110.

The upper ridge 196 may protrude from the upper conductive wall 190 into the cavity of the waveguide. The upper ridge 196 may be formed not to contact the conductive ridge 126 thereunder, that is, to have a certain distance from the conductive ridge 126. The upper ridge 196 may be located symmetrically with the conductive ridge 126 beneath the upper ridge 196. A wave may propagate along the space between the upper ridge 196 and the conductive ridge 126. As such, an H-shaped ridge gap waveguide 102 having unique characteristics different from the above U-shaped structure may be obtained.

Figure 16:
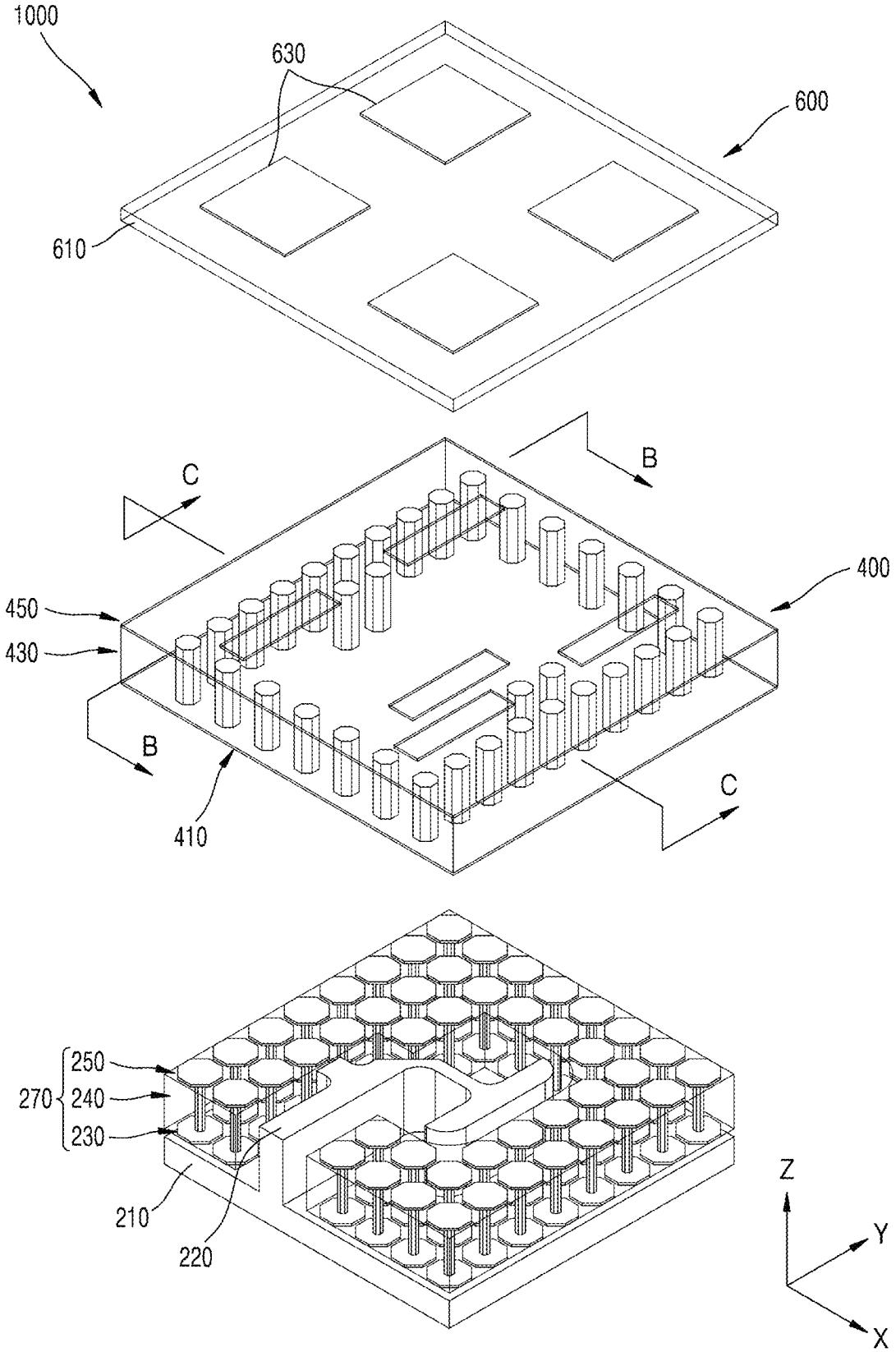
FIG. 16 illustrates a schematic structure of an antenna array according to an embodiment.

FIG. 16 illustrates a schematic structure of an antenna array according to an embodiment.

An antenna array 1000 according to an embodiment may include a conductive base 210, a conductive ridge 220 protruding upward from the conductive base 210 and extending along a predetermined wave transmission direction, an EBG structure 270 arranged adjacent to the conductive ridge 220 over the conductive base 210, and an SIW resonator 400 arranged over the conductive ridge 220 and the EBG structure 270.

Figure 17A:
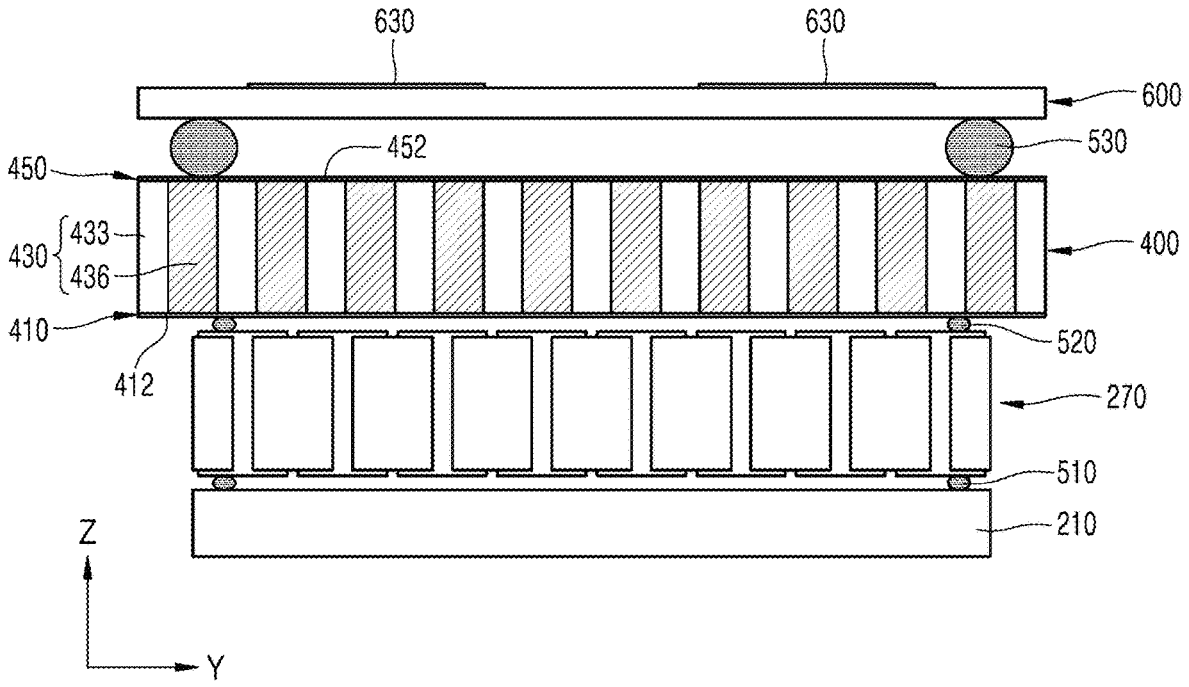
FIG. 17A is a B-B cross-sectional view of the antenna array of FIG. 16.

FIG. 17A is a B-B cross-sectional view of the antenna array of FIG. 16. As illustrated in FIG. 17A, the SIW resonator 400 may include a lower conductive layer 412 spaced apart from the conductive ridge 220 by a gap to form a waveguide with the conductive ridge 220, and an upper conductive layer 452 forming a resonant cavity with the lower conductive layer 412. That is, the lower conductive layer 412 may constitute a waveguide section with the conductive ridge 220 and the EBG structure 270 arranged under the lower conductive layer 412 and may also constitute a resonator section with the upper conductive layer 512.

The antenna array 1000 may further include a radiator 600 arranged over the SIW resonator 400 and including a conductive patch 630. Herein, the antenna array 1000 is illustrated as including the radiator 600; however, the radiator 600 is an optional component and may be omitted.

The EBG structure 270 may be substantially the same as the EBG structure 170 of the RGW 100 described above.

The EBG structure 270 may be provided in the waveguide section such that an electromagnetic wave propagates in a desired direction and does not leak in other directions, and may be arranged spaced apart from at least one of the conductive base 210 or the lower conductive layer 412 of the SIW resonator 400 with an air gap therebetween.

Referring back to FIG. 16, the EBG structure 270 may be formed based on a double-sided printed circuit board and may include a first layer 230, a second layer 240, and a third layer 250. The first layer 230 and the third layer 250 may include a plurality of conductive patterns arranged to face each other. The second layer 240 may include a dielectric layer and a conductive via connecting a plurality of conductive patterns facing each other in the first layer 230 and the third layer 250.

The EBG structure 270 may have a shape including a plurality of cells that are arranged in a two-dimensional periodic lattice structure and are not electrically coupled to each other. The EBG structure 270 may form a bandgap in a region between the conductive base 210 and the lower conductive layer 412 of the SIW resonator 400 in an operating frequency band to block the propagation (leakage) of a predetermined frequency band of waves to the space outside the waveguide section.

The SIW resonator 400 may include three layers, that is, an input layer 410, an intermediate layer 430, and an output layer 450. This structure may be manufactured based on a double-sided printed circuit board.

Figure 17B:
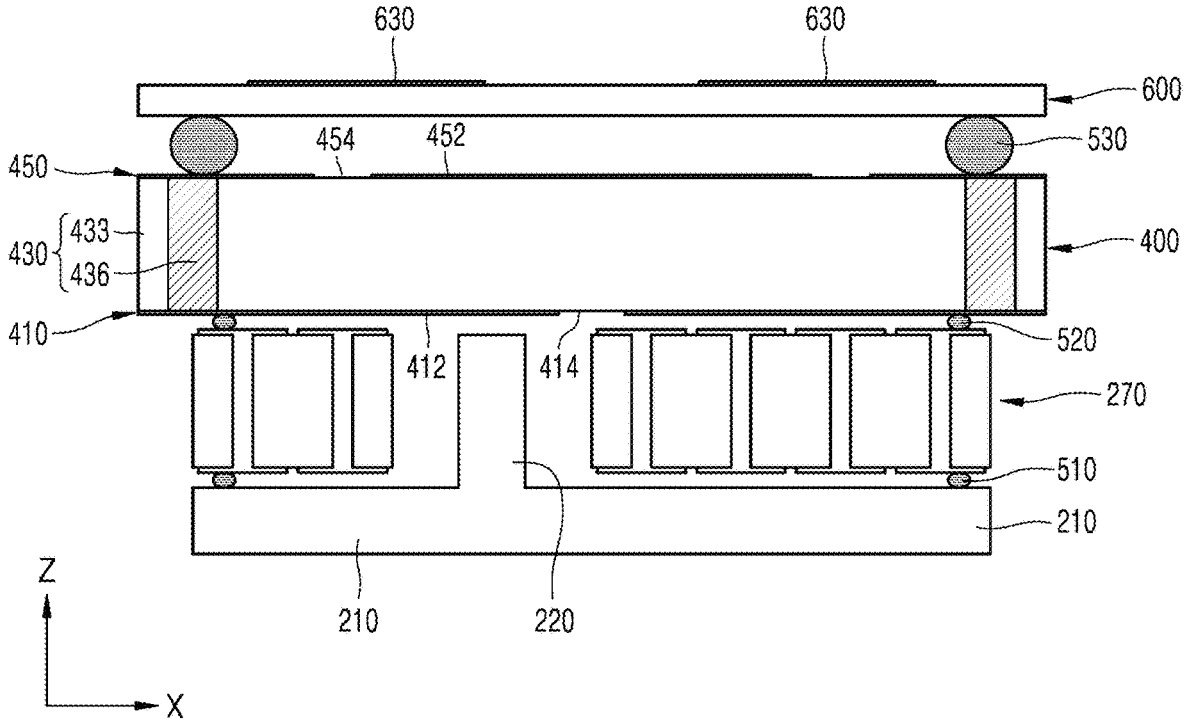
FIG. 17B is a C-C cross-sectional view of the antenna array of FIG. 16.

FIG. 17B is a C-C cross-sectional view of the antenna array of FIG. 16. As illustrated in FIG. 17B, the input layer 410 may include a lower conductive layer 412 and an input slot 414. The input slot 414 may be a region not covered with a conductive material among the regions of the upper surface of a dielectric layer 433. That is, a nonconductive portion at the lower surface of the double-sided printed circuit board becomes the input slot 414.

The output layer 450 may include a lower conductive layer 412 and an output slot 454. The output slot 454 may be a region not covered with a conductive material among the regions of the lower surface of the dielectric layer 433. That is, a nonconductive portion at the upper surface of the double-sided printed circuit board becomes the output slot 454.

The input slot 414 and the output slot 454 may be manufactured in any suitable number as slots having the size and shape required in a conductive layer provided at the printed circuit board.

The intermediate layer 430 may include a dielectric layer 433 arranged between the input layer 410 and the output layer 450, and a plurality of conductive elements 436 connecting the input layer 410 to the output layer 450 and forming a sidewall of the entire resonant cavity. A conductive element 436 may be a metallic via passing through the dielectric layer 433, may have a pin shape, and may be any other suitable conductive element.

The upper conductive layer 452, the lower conductive layer 412, and the plurality of conductive elements 436 may respectively form an upper wall, a lower wall, and a sidewall of the resonant cavity. The distance between the plurality of conductive elements 436 may be set to prevent the leakage of power to the outside of the SIW resonator 400. An additional conductive element for matching with the SIW resonator 400 may be further provided in the resonant cavity.

The size of the SIW resonator 400 may be selected to generate a propagating wave mode in the resonant cavity, thereby allowing the SIW resonator 400 to operate in a low-loss mode. The matching with the SIW resonator 400 may be performed by an additional pin that may be located in the cavity.

Radiation may occur directly from the output slot 454 of the SIW resonator 400. Alternatively, as illustrated in FIG. 16, when the radiator 600 is provided, radiation may occur through the conductive patch 630 of the radiator 600.

The radiator 600 may include a dielectric layer 610 arranged such that one surface thereof faces the output layer 450 of the SIW resonator 400, and a conductive patch 630 formed on another surface of the dielectric layer 610. The conductive patch 630 may be arranged to face the output slot 454 of the SIW resonator 400.

The radiator 600 may be manufactured based on a single-sided printed circuit board, that is, the conductive patch 630 may be formed from a conductive portion (microstrip) provided at the printed circuit board.

As illustrated in FIGS. 17A and 17B, a spacer 530 may be arranged to provide an air gap between the SIW resonator 400 and the radiator 600. A spacer 520 may be arranged to provide an air gap between the EBG structure 270 and the SIW resonator 400, that is, between the EBG structure 170 and the lower conductive layer 412. A spacer 510 may be arranged to provide an air gap between the conductive base 210 and the EBG structure 270.

The EBG structure 270, the SIW resonator 400, and the radiator 600 may all be manufactured based on a printed circuit board. The EBG structure 270 may be manufactured based on a double-sided printed circuit board, and a concave portion for locating the conductive ridge 220 protruding from the conductive base 210 may be formed at the printed circuit board. That is, the EBG structure 270, the conductive base 210, and the conductive ridge 220 may be assembled such that the conductive ridge 220 may be arranged at the concave portion. The SIW resonator 400 may also be manufactured based on a double-sided printed circuit board, and the radiator 600 may be manufactured based on a single-sided printed circuit board.

The lower conductive layer 412 of the input layer 410 of the SIW resonator 400 may function as an upper wall of the waveguide, and the upper conductive layer 452 provided at the output layer 450 of the SIW resonator 400 may function as a lower conductive layer for the conductive patch 630 provided at the radiator 600.

The printed circuit boards may be arranged to be separated from the conductive base 210 and from each other by the spacers 510, 520, and 530 providing a predefined air gap. That is, the antenna array 1000 may include only two (or three when including a radiator) simple printed circuit boards and one simple mechanical component. Not all of the components constituting the antenna array 1000 may need to directly contact each other. This structure may greatly simplify the manufacturing process of the antenna array 1000 and may reduce the requirements for the accuracy and tolerance thereof.

Figure 18:
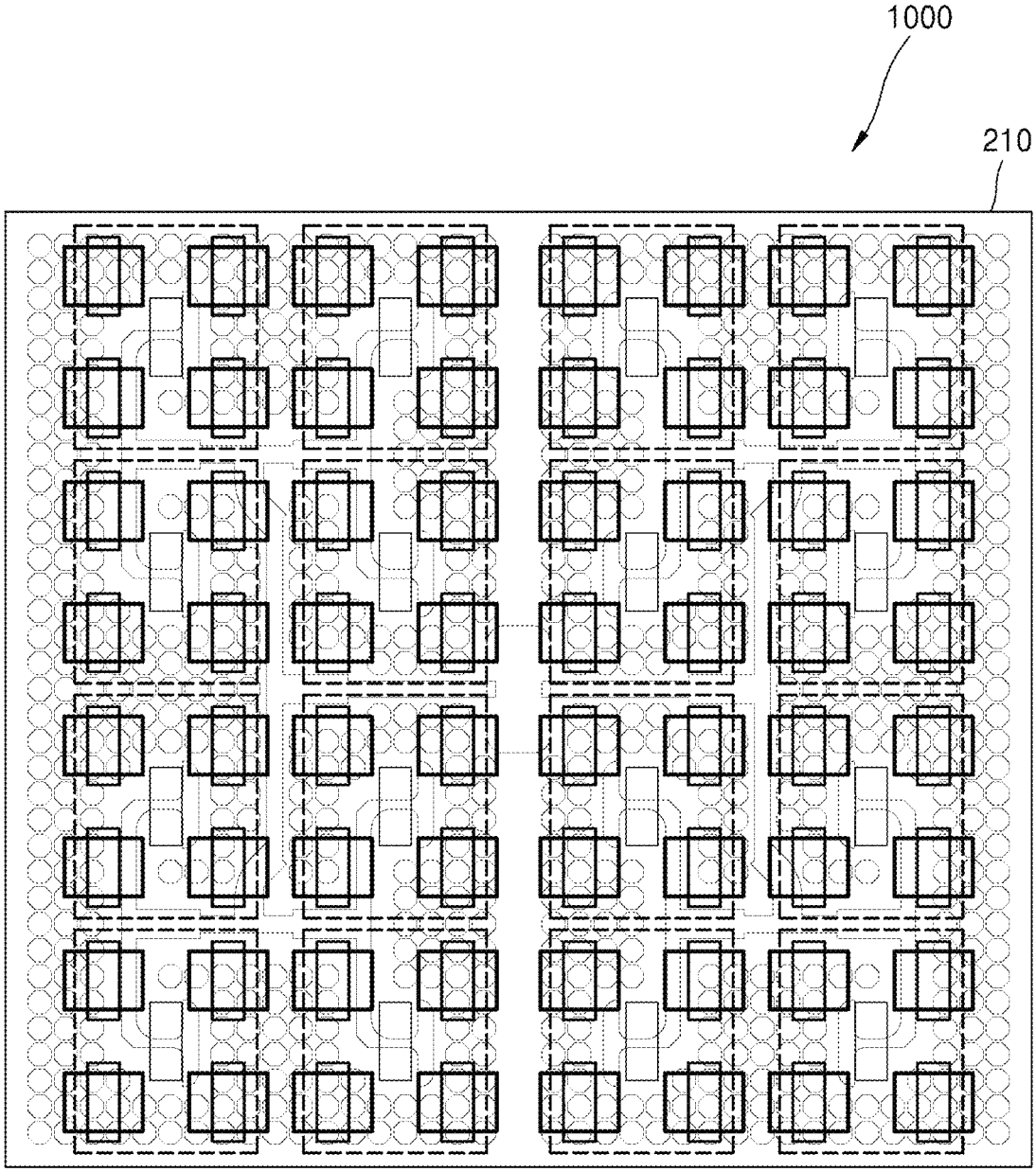
FIG. 18 is a plan view of an 8×8 basic cell array as an expansion of the antenna array of FIG. 16.
Figure 19:
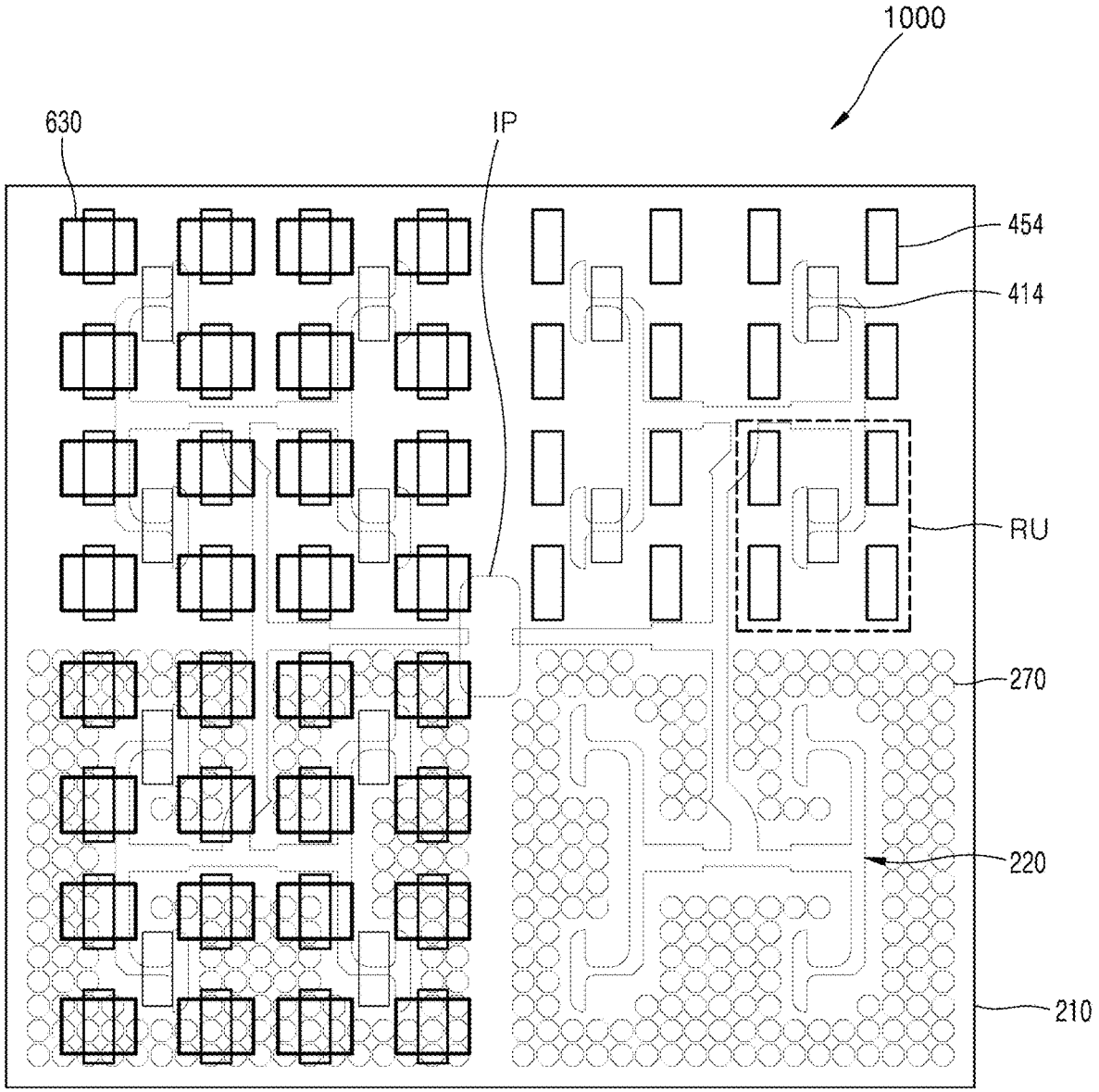
FIG. 19 is a diagram in which the plan view of FIG. 18 is divided into four quadrants and overlapping components are represented differently in each quadrant.

FIG. 18 is a plan view of an 8×8 basic cell array as an expansion of the antenna array of FIG. 16 on a conductive base 210. FIG. 19 is a diagram in which the plan view of FIG. 18 is divided into four quadrants and overlapping components are represented differently in each quadrant.

The structure illustrated in FIG. 16 may correspond to a 2×2 basic cell. For better understanding, the antenna array is divided into four equal quadrants in FIG. 19. The lower right quadrant illustrates only the EBG structure 270 and the conductive ridge 220, and the upper right quadrant illustrates the conductive ridge 220 and the input slot 414 and output slot 454 of the SIW resonator 400 superimposed on the antenna array. The upper left quadrant illustrates the conductive ridge 220, the input slot 414 and the output slot 454 of the SIW resonator 400 superimposed on the antenna array, and the conductive patch 630 of the radiator 600 further superimposed on the antenna array. The lower left quadrant illustrates all the components illustrated in the other three quadrants.

As shown in FIG. 19, one input slot 414 and four output slots 454 may form a basic unit RU that is repeatedly arranged in the SIW resonator 400. However, the number of input slots 414 and output slots 454 included therein is merely an example and the disclosure is not limited thereto.

An input port IP may be located at the center of the waveguide section of the antenna array 1000, that is, at the center of the waveguide formed by the conductive ridge 220 and the lower conductive layer 412 of the SIW resonator 400, and power may be supplied therethrough to the antenna. The input port IP may be a rectangular waveguide port or a coaxial port.

The conductive ridge 220 protruding from the conductive base 210 and extending along a required propagation direction may have a shape suitable for wave distribution and may function as a waveguide divider.

The conductive ridge 220 may have a shape for distributing the power input from the input port IP to a plurality of input slots 414 provided in the SIW resonator 400. The conductive ridge 220 may have a shape for distributing power to the plurality of input slots 414 at equal amplitude and phase. As illustrated in FIG. 19, the conductive ridge 220 may have a shape for transmitting power with the same phase and amplitude to 16 input slots 414.

The cross section of the conductive ridge 220 may have a rectangular shape or a square shape or may have any other shape and size suitable for the function of a waveguide divider, that is, suitable for distributing an electromagnetic wave well in a desired form without loss.

A region around the conductive ridge 220 may be filled with the EBG structure 270, the leakage of an electromagnetic wave to the external space may be blocked by the EBG structure 270, and the wave may be transmitted and distributed in the wave propagation direction in which the conductive ridge 220 extends.

Each basic unit RU of the SIW resonator 400 may perform power division and supply a portion of the power obtained through the resonant cavity to each output slot 454 at equal phases and amplitudes.

Figure 20:
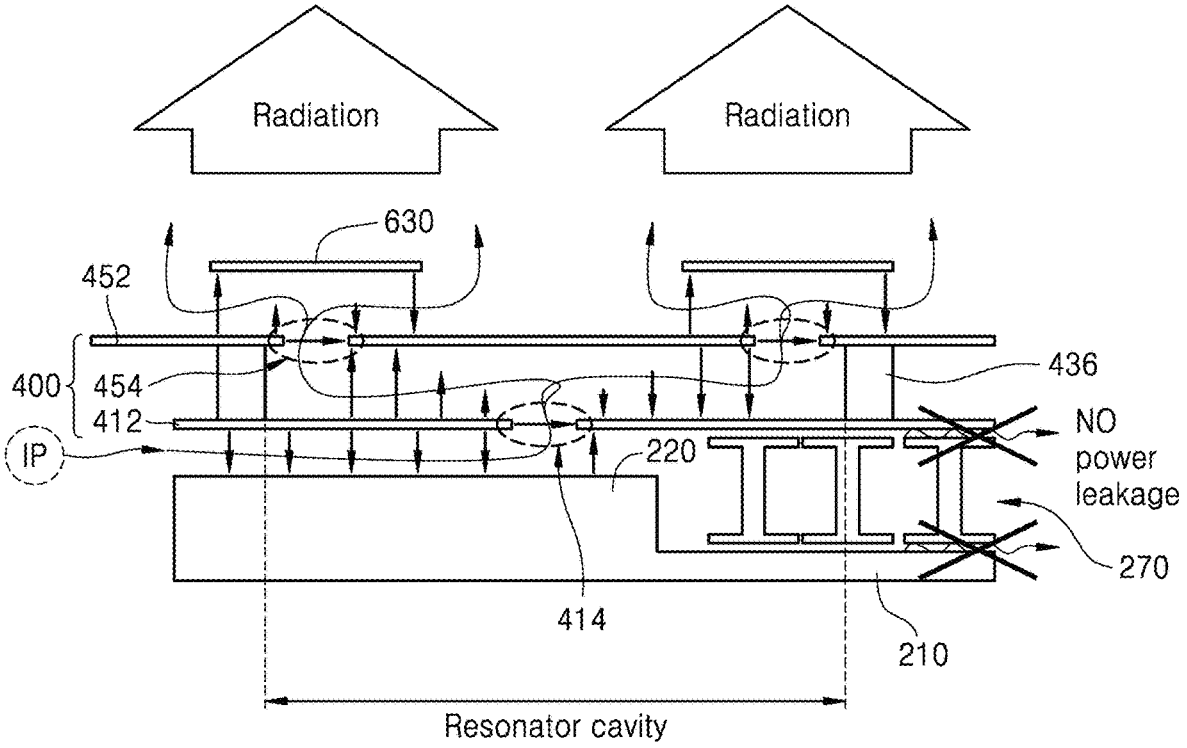
FIG. 20 illustrates a power flow of an antenna array according to an embodiment.

FIG. 20 illustrates a power flow of an antenna array according to an embodiment. A detailed diagram of the power flow in the antenna array 1000 is conceptually illustrated in FIG. 20. Thick straight arrows represent electric field lines, and thin curved arrows represent the directions of power flow along the components in the antenna array 1000.

First, the power transmitted from the input port IP may propagate along the region between the conductive ridge 220 and the lower conductive layer 412, and may be transmitted to the input slot 414 of the SIW resonator 400. Due to the EBG structure 270, the power may not flow outside the waveguide and may be almost completely transmitted to the resonator cavity of the SIW resonator 400. Next, the power may be transmitted to the output slot 454 along the resonator cavity surrounded by the conductive element 436, the upper conductive layer 452, and the lower conductive layer 412.

As described above, the power may be radiated directly from the output slot 454 of the SIW resonator 400, and the radiation may be performed by using the conductive patch 630 that is the antenna element when the radiator is present.

Because the input slot 414 and output slot 454 of the SIW resonator 400 are formed as slots in the conductive layer of the double-sided printed circuit board, a convenient connection not requiring a direct contact may be provided between the radiator and the waveguide adjacent to the SIW resonator 400 and the in-phase excitation of an antenna array aperture may be provided. The resonator and patch antenna elements may be excited at a central point with an electric field of 0.

Figure 21:
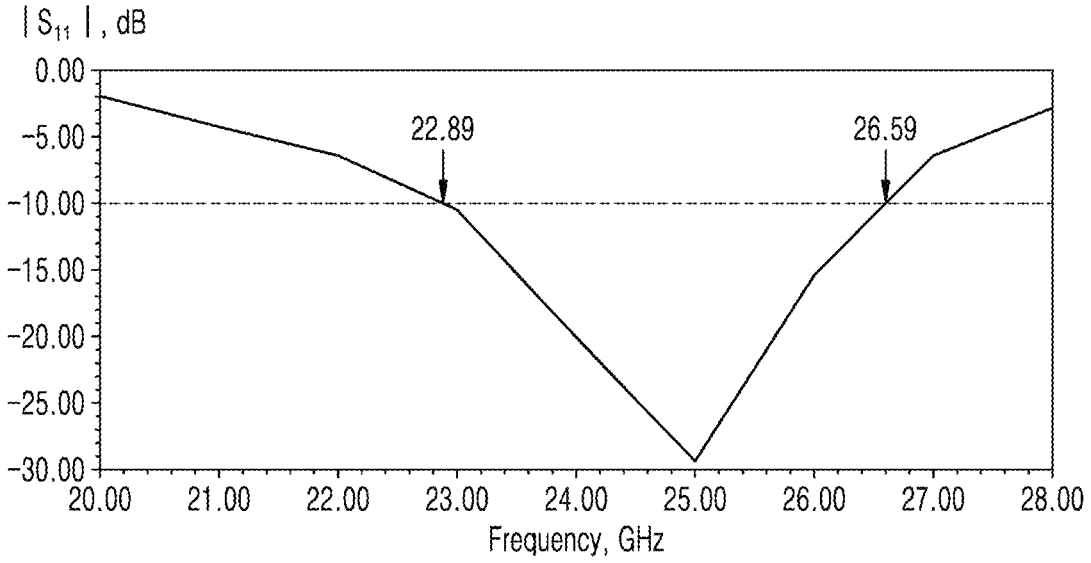
FIG. 21 illustrates an operating frequency band of an antenna array according to an embodiment.

In general, when estimating an insertion loss in a power supply circuit of the current antenna, when the distance between the elements of the 8×8 antenna element is about 0.6λ and the input port is located at the center of the waveguide section, the average distance from the input port to each element is about 7*0.6λ, that is, about 5.25 cm at a frequency of about 24 GHz and a wavelength of about 1.25 cm. The solution of the related art based on the microstrip transmission lines under these conditions exhibits an insertion loss at about 2.1 dB (about 62% efficiency) level, while the disclosure exhibits an insertion loss at about 0.3 dB (about 93% efficiency) level. FIG. 21 illustrates an operating frequency band, and it may be seen that a frequency band of $S_{11}$<−10 dB level is about 15%. The radiation efficiency is about 93% or more in the operating frequency band.

Figure 22:
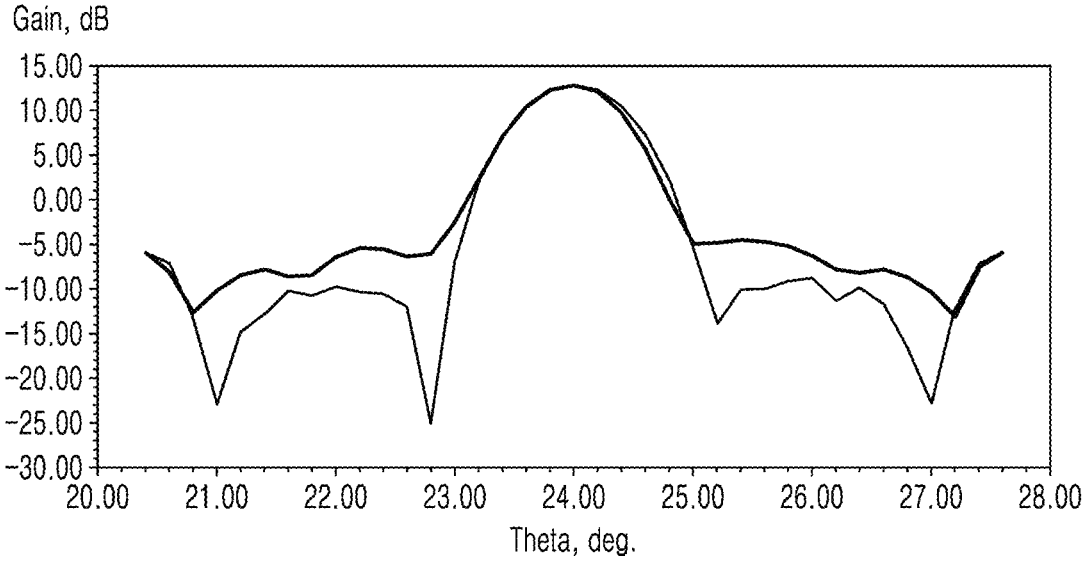
FIG. 22 illustrates a radiation pattern of an antenna array according to an embodiment.

FIG. 22 illustrates a radiation pattern of an antenna array according to an embodiment. Because radiation elements are symmetrically distributed on the surface of the antenna array, it may have a low-level side lobe at a wide-range scanning angle and may provide high beamforming accuracy.

Figure 23:
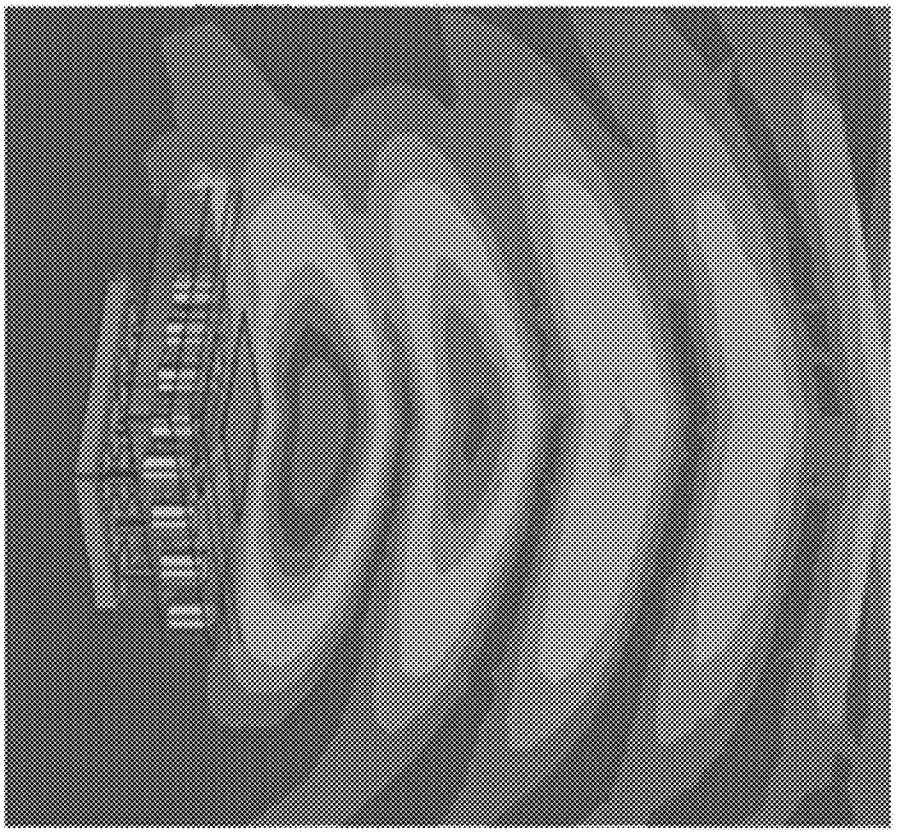
FIG. 23 illustrates a radiation diagram of an antenna array according to an embodiment

FIG. 23 illustrates a radiation diagram of an antenna array according to an embodiment. As may be seen from the drawings, the radiation diagram of the antenna array exhibits high symmetry.

Thus, the antenna array 1000 may be expandable, compact, wideband, and low-loss, may have improved beamforming characteristics, and may be successfully used for applications in millimeter waves and tera-hertz (THz) bands.

The proposed antenna array 1000 may operate effectively even without the radiator 600, and the operating frequency band of the antenna array 1000 may be extended when the radiator 600 is provided.

Herein, the configuration principles and basic examples of the RGW, the SIW resonator, and the multilayer antenna array based thereon are merely examples. That is, those of ordinary skill in the art using these principles may achieve other embodiments derived from those described herein.

The antenna according to the disclosure may be used for electronic devices requiring control of high-frequency signals, such as millimeter-wave bands for mobile networks of future standard 5G and WiGig, other sensors, wireless fidelity (Wi-Fi) networks, wireless power transmission including long-distance, smart home systems, other millimeter-wave adaptive intelligent systems, car navigation, Internet of Things (loT), wireless charging, and the like. The disclosed RGW may be used in various types of waveguide devices such as amplifiers, switches, phase shifters, antennas, and filters.

The function of an element specified as a single element in the description or the claims may be implemented through various components of a device, and vice versa, the function of elements described as a plurality of individual elements in the description or the claims may be substantially implemented through a single element.

Herein, the elements/units of the device may be arranged in a common housing on the same frame/structure/printed circuit board, and may be structurally connected to each other by a mounting (assembly) operation and functionally through a communication line. Unless otherwise specified, communication lines or channels may be those of the related art the material implementation of which does not require creative efforts. The communication lines may be cables, cable sets, buses, paths, and/or wireless communication links (induction, radio frequency, infrared, ultrasonic, etc.). Communication protocols through communication links are known in the art and are not disclosed separately.

The functional relationship between elements should be understood as a connection through which the elements cooperate properly with each other and implement a particular function of the elements. Examples of the functional relationship may include a connection providing information exchange, a connection providing current transmission, a connection providing transmission of mechanical movement, and a connection providing transmission of light, sound, or electromagnetic or mechanical vibration. The functional relationship may be determined by the nature of the interaction between the elements and may be provided by a known means by using a principle known in the art, unless otherwise specified.

Structural embodiments of the components of the device are known to those of ordinary skill in the art and are not described separately herein unless otherwise specified. The elements of the device may be made of any suitable materials. These components may be manufactured by using known methods including machining and lost wax casting. Assembly, connection, and other operations according to the above description may also correspond to the knowledge of those of ordinary skill in the art and thus will not be described here in detail.

The disclosed RGW may have a large tolerance range and thus may not require high-precision manufacturing and may effectively block wave leakage to the outside and thus may achieve a very low loss.

The disclosed RGW may not require a strong and reliable contact between the layers in assembly and may have a large tolerance range, thereby not requiring high-precision manufacturing.

The disclosed antenna array may include the above RGW, and thus, may exhibit low-loss, wideband, and improved beamforming characteristics.

The above antenna array may operate effectively even without the radiator and may have an extended operating frequency band with the radiator.

The antenna array may be manufactured based on two or three simple printed circuit boards and the direct contact between the components thereof may be minimized. Thus, the manufacturing process of the antenna array may be simplified to reduce the requirements for the accuracy and tolerance.

While the disclosure has been shown and described with reference to embodiments thereof, it will be understood by those skilled in the art that various changes in form and details may be made therein without departing from the sprit and scope as defined by the appended claims and their equivalents.

What is claimed is:

1. A ridge gap waveguide, comprising:

a conductive base;

a conductive ridge protruding upward from the conductive base and extending along a predetermined wave transmission direction;

an upper conductive wall located over the conductive base and the conductive ridge and spaced apart from the conductive ridge by a gap; and an electromagnetic bandgap (EBG) structure arranged adjacent to the conductive ridge between the conductive base and the upper conductive wall, wherein the EBG structure includes a plurality of cells that are arranged in a two-dimensional periodic lattice structure and are not electrically coupled to each other, and wherein each of the plurality of cells includes:

a dielectric layer, a first conductive pattern and a second conductive pattern respectively formed at a lower surface and an upper surface of the dielectric layer, and a conductive via passing through the dielectric layer and connecting the first conductive pattern to the second conductive pattern.

2. The ridge gap waveguide of claim 1, wherein the EBG structure is spaced apart from at least one of the conductive base and the upper conductive wall by an air gap.

3. The ridge gap waveguide of claim 1, further comprising a spacer arranged in at least one of a position between the EBG structure and the conductive base and a position between the EBG structure and the upper conductive wall, the spacer fixing the EBG structure and providing an air gap in at least one of a position between the EBG structure and the conductive base and a position between the EBG structure and the upper conductive wall.

4. The ridge gap waveguide of claim 3, wherein the spacer includes a shape protruding toward the EBG structure from an upper surface of the conductive base or a lower surface of the upper conductive wall.

5. The ridge gap waveguide of claim 3, wherein the spacer is located not to simultaneously contact adjacent cells that are included in the EBG structure and are adjacent to each other.

6. The ridge gap waveguide of claim 5, wherein the EBG structure is formed based on a double-sided printed circuit board.

7. The ridge gap waveguide of claim 6, wherein the double-sided printed circuit board includes a concave portion, and wherein the conductive ridge is arranged at the concave portion.

8. The ridge gap waveguide of claim 1, wherein the conductive ridge includes a pattern for filtering an electromagnetic wave of a predetermined frequency.

9. The ridge gap waveguide of claim 1, further comprising an upper ridge protruding toward the conductive ridge from the upper conductive wall and maintaining a distance from the conductive ridge.

10. An antenna array, comprising:

the ridge gap wave guide of claim 1, the conductive ridge being connected to an input port;

an electromagnetic bandgap (EBG) structure arranged adjacent to the conductive ridge over the conductive base; and a substrate integrated waveguide (SIW) resonator arranged over the conductive ridge and the EBG structure, wherein the SIW resonator includes:

the upper conductive wall as a lower conductive layer spaced apart from the conductive ridge by a gap and forming a waveguide with the conductive ridge, and an upper conductive layer forming a resonant cavity with the lower conductive layer.

11. The antenna array of claim 10, wherein the EBG structure includes a plurality of cells that are arranged in a two-dimensional periodic lattice structure and are not electrically coupled to each other, and wherein each of the plurality of cells includes:

a first dielectric layer, a first conductive pattern and a second conductive pattern respectively formed at a lower surface and an upper surface of the first dielectric layer, and a conductive via passing through the first dielectric layer and connecting the first conductive pattern to the second conductive pattern.

12. The antenna array of claim 11, wherein the EBG structure is formed based on a first double-sided printed circuit board.

13. The antenna array of claim 11, wherein the SIW resonator includes:

an input layer including the lower conductive layer and an input slot;

an output layer including the upper conductive layer and an output slot; and an intermediate layer including a second dielectric layer arranged between the input layer and the output layer, and a plurality of conductive elements connecting the input layer to the output layer and forming a sidewall of the resonant cavity.

14. The antenna array of claim 13, wherein the conductive element includes a metallic via passing through the second dielectric layer.

15. The antenna array of claim 13, wherein the SIW resonator is formed based on a second double-sided printed circuit board.

16. The antenna array of claim 13, wherein a distance between the plurality of conductive elements is set to prevent a power leakage to outside from the SIW resonator.

17. The antenna array of claim 13, further comprising an additional conductive element located in the resonant cavity and used for matching with the SIW resonator.

18. The antenna array of claim 13, further comprising a radiator arranged over the SIW resonator and including a conductive patch facing the output slot.

19. The antenna array of claim 18, further comprising a spacer located between the radiator and the SIW resonator and providing an air gap between the radiator and the SIW resonator.

20. The antenna array of claim 10, wherein the input port is located at a center portion of the waveguide formed by the conductive ridge and the lower conductive layer.

21. The antenna array of claim 13, wherein the input slot included in the SIW resonator includes a plurality of input slots, and wherein the conductive ridge includes a shape that distributes power to the plurality of input slots at equal amplitude and phase.

* * * * *